US007364253B2

(12) United States Patent
Hashimoto et al.

(10) Patent No.: US 7,364,253 B2
(45) **Date of Patent: *Apr. 29, 2008**

(54) LIQUID DROP JET HEAD, INK CARTRIDGE AND INK JET RECORDING APPARATUS

(75) Inventors: Kenichiro Hashimoto, Kanagawa (JP); Mitsumi Fujii, Iwate (JP); Tomomi Katoh, Kanagawa (JP); Tsuneo Maki, Kanagawa (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 347 days.

This patent is subject to a terminal disclaimer.

(21) Appl. No.: 11/135,260

(22) Filed: May 23, 2005

(65) Prior Publication Data

US 2005/0219321 A1 Oct. 6, 2005

Related U.S. Application Data

(63) Continuation of application No. 10/721,209, filed on Nov. 25, 2003, now Pat. No. 6,913,348, which is a continuation of application No. 10/102,464, filed on Mar. 20, 2002, now Pat. No. 6,682,185.

(30) Foreign Application Priority Data

Mar. 28, 2001 (JP) ..... 2001-093574

(51) Int. Cl.
*B41J 2/015* (2006.01)
*B41J 2/175* (2006.01)

(52) U.S. Cl. ..... 347/20; 347/86

(58) Field of Classification Search ..... 347/68, 347/86, 20

See application file for complete search history.

(56) References Cited

U.S. PATENT DOCUMENTS

| | | | |
|---|---|---|---|
| 5,808,644 | A | 9/1998 | Imamura et al. |
| 5,826,333 | A | 10/1998 | Iketani et al. |
| 5,828,394 | A | 10/1998 | Khuri-Yakub et al. |
| 5,912,684 | A | 6/1999 | Fujii et al. |
| 6,260,962 | B1 | 7/2001 | Yano et al. |
| 6,378,994 | B1 | 4/2002 | Ueda et al. |
| 6,682,185 | B2 | 1/2004 | Hashimoto et al. |
| 6,913,348 | B2 * | 7/2005 | Hashimoto et al. ..... 347/65 |

FOREIGN PATENT DOCUMENTS

| | | |
|---|---|---|
| JP | 7132595 | 5/1995 |
| JP | 7276626 | 10/1995 |

OTHER PUBLICATIONS

U.S. Appl. No. 09/550,408, filed Apr. 14, 2000.

* cited by examiner

*Primary Examiner*—An H. Do
(74) *Attorney, Agent, or Firm*—Cooper & Dunham, LLP

(57) ABSTRACT

A liquid drop jet head includes a nozzle jetting a liquid drop, a liquid room connected to the nozzle, a common liquid room connected to the liquid room, a supply opening part supplying the liquid to the common liquid room, and a pressure generating part generating a pressure which pressurizes the liquid provided in the liquid room, wherein the common liquid room has a configuration in which a width of the common liquid room on a plane level is narrower as a point of the width is more remote from the supply opening part.

18 Claims, 20 Drawing Sheets

LIQUID DROP JET HEAD, INK CARTRIDGE AND INK JET RECORDING APPARATUS

CROSS-REFERENCE TO RELATED APPLICATIONS

This application is a Rule 1.53(b) Continuation of U.S. Ser. No. 10/721,209, filed Nov. 25, 2003, now U.S. Pat. No. 6,913,348, issued Jul. 5, 2005, which in turn is a continuation of U.S. Ser. No. 10/102,464, filed Mar. 20, 2002, now U.S. Pat. No. 6,682,185, issued Jan. 27, 2004, the entire contents of each of which are incorporated by reference herein.

BACKGROUND OF THE INVENTION

1. Field of the Invention

The present invention generally relates to liquid drop jet heads and ink jet recording apparatuses, and more particularly, to a liquid drop jet head used for an ink jet recording apparatus and the ink jet recording apparatus used as a picture recording apparatus or picture forming apparatus.

2. Description of the Related Art

An ink jet recording apparatus is used as a picture forming apparatus or picture recording apparatus such as a printer, facsimile, or copy machine. An ink jet head is used for the ink jet recording apparatus as a liquid drop jet head. The ink jet head includes a nozzle, a liquid room, and a pressure generating means. An ink drop is jetted out by the nozzle. The nozzle is connected to the liquid room. The liquid room is called a pressurized liquid room, pressure room, jet room, or ink channel. The ink in the liquid room is pressurized by the pressure generating means. The ink drop is jetted out from the nozzle due to the pressure in the liquid room generated by the pressure generating means.

There are several types of ink jet heads such as a piezo type, a bubble type (thermal type) or an electrostatic type. In the piezo type ink jet head, the ink drop is jetted out by deforming or displacing a vibration board forming a wall surface of the liquid room with a electric machine conversion element such as a piezoelectric element. In the bubble type ink jet head, the ink drop is jetted out by a bubble generated by boiling an ink film with an electric heat conversion element. In the static electricity type ink jet head, the ink drop is jetted out by deforming the vibration board with an electrostatic force caused by the vibration board (or an electrode united with the vibration board) forming the wall surface of the liquid room and an electrode facing the vibration board.

In a related art ink jet head, a liquid room and a common liquid room connected to the liquid room are made of photosensitive resin, resin mold, metal, glass or others. However, since the liquid room made of resin has low rigidity, cross talk is apt to occur between neighboring liquid rooms so that it is not possible to obtain a high quality picture. On the other hand, a liquid room made of metal or glass has high rigidity so that the problem regarding cross talk is small. However, since it is difficult for the liquid room made of metal or glass to be processed, it is difficult to meet a demand that the ink jet head have a high density to obtain a high quality picture.

In order to solve the above mentioned problems, for example, it is proposed to form the liquid room or the common liquid room by anisotropic-etching of a silicon substrate (silicon wafer), in Japanese Laid-Open Patent Applications No. 7-132595 and No. 7-276626. The silicon has a high rigidity and can be fine-processed by anisotropic-etching. Particularly, it is possible to form a perpendicular wall surface by using the silicon wafer of a surface direction of (110), so that the liquid room can be arranged with high density.

FIG. 1 is a plan view for explaining a configuration of the liquid room of a related art ink jet head. The liquid room structure of the related art shown in FIG. 1 is made by anisotropic-etching of the silicon substrate of the surface direction of (110). Plural liquid rooms 201, a common liquid room 202 and an ink supply opening part 203 are arranged in the liquid room structure. Each of the liquid rooms 201 has a configuration of a parallelogram on a plane level. The common liquid room 202 has a polygonal configuration consisting of plural parallelograms on a plane level. The common liquid room 202 is connected to the liquid rooms 201 by a fluid resister part (ink supply channel) not shown in FIG. 1. The ink is supplied from outside of the ink jet head to the common room 202 by the ink supply opening part 203.

When the liquid room 201 or the common liquid room 202 is formed by anisotropic-etching of the silicon substrate, the configuration of the liquid room 201 or the common liquid room 202 is formed only in a direction along a crystal direction due to anisotropy of the silicon substrate. Therefore, although the liquid rooms 201 are formed at a side of the direction along the crystal direction of the silicon substrate, the common liquid room 202 having a larger area than the liquid rooms 201 has a configuration tightly consisting of the tightly spaced plural parallelograms formed to a direction of the row of the liquid rooms 201. Therefore, as shown in FIG. 1, the common liquid room 202 has wall surface parts 202*a* and 202*b* which are along the row of the liquid rooms 201 and which have a configuration of saw teeth.

Meanwhile, a bubble often gets into the liquid room or the common liquid room in the ink jet head, when an ink tank is exchanged or due to an external vibration. Because of this, a bubble discharge method is applied as an operation for recovering reliability in an ink jet recording apparatus. In the method, the ink is absorbed from the nozzle or an outlet for the bubble, so that the bubble is removed together with the ink.

However, as described above, the wall surface of the common liquid room has the configuration of the saw teeth on a plane level. Therefore, a current speed of the ink supplied from the ink supply opening part 203 is reduced by the wall surfaces 202*a* and 202*b* of the common room 202. As a result, a bubble B adheres to a corner part of the wall surfaces 202*a* and 202*b*, the wall surfaces 202*a* and 202*b* having the configuration of saw teeth, so that the bubble B is not discharged. The bubble B may be left even if the bubble discharge method is applied as the operation for recovering reliability.

In this case, a bubble discharge may be improved by cutting the corner part of the wall surfaces 202*a* and 202*b* obliquely. However, there is a still problem in that the speed of the ink is reduced at an area remote from the ink supply opening part 203 by the wall surfaces 202*a* and 202*b* having the configuration of saw teeth during the operation the bubble discharge method. As a result, it is not possible to discharge the bubble completely.

Furthermore, during the ink jet operation, the ink is not sufficiently supplied to a liquid room remote from the ink supply opening part 203 so that bad jetting may result.

In addition, generally, a common liquid room connected to plural liquid rooms has a large opening area. Particularly, the opening area is further increased as the number of the nozzles increases for the high density and high speed recording. As a result, the strength of the ink jet head is reduced so that a yield rate is reduced due to damage of the ink jet head during assemble.

Furthermore, the common liquid room has a large opening part. Therefore, when a nozzle board is connected, the nozzle board is bent, damaged, or incorrectly-connected due to a non-uniform load while connecting, at the common liquid room.

SUMMARY OF THE INVENTION

Accordingly, it is a general object of the present invention to provide a novel and useful liquid drop jet head, ink cartridge, and ink jet recording apparatus in which one or more of the problems described above are eliminated.

Another and more specific object of the present invention is to provide a liquid drop jet head, by which a bubble saved in a common liquid room is discharged smoothly, and by which liquid is supplied to all liquid rooms sufficiently and stable jetting of a liquid drop is implemented during an operation of jetting of the liquid drop. It is also the object of the present invention to provide an ink cartridge into which the liquid drop jet head is integrated, and an ink jet recording apparatus where the liquid drop jet head is loaded.

The above objects of the present invention are achieved by a liquid drop jet head, including a nozzle jetting a liquid drop, a liquid room connected to the nozzle, a common liquid room connected to the liquid room, a supply opening part supplying the liquid to the common liquid room, and a pressure generating part that generates a pressure pressurizing the liquid provided in the liquid room, wherein the common liquid room has a configuration in which a width of the common liquid room on a plane level is narrower as a point of the width is more remote from the supply opening part.

According to the present invention as described above, it is possible to prevent a flow speed of a liquid from slowing so that a bubble can be discharged smoothly. Hence, bad jetting of a drop can be prevented.

The width of the common liquid room on the plane level may be narrower substantially consecutively as the point of the width is more remote from the supply opening part. The width of the common liquid room on the plane level may be narrower substantially gradually as the point of the width is more remote from the supply opening part.

According to the present invention as described above, it is possible to obtain a smooth flow of the liquid and prevent the flow speed of the liquid from reducing. Hence, bad jetting of a drop can be prevented.

The common liquid room may have a configuration of a single wing on a plane level.

According to the present invention as described above, it is possible to obtain a smooth flow of the liquid and prevent the flow speed of the liquid from reducing. Hence, bad jetting of a drop can be prevented.

The supply opening part may be provided at a wall surface side opposite side to the liquid room in the common liquid room, an external side of the wall surface, or an external side of the liquid room in a direction of a line of the liquid room.

According to the present invention as described above, it is possible to prevent the bubble from being stagnated between the supply opening part and the wall surface.

The common liquid room may have a configuration of dual wings on a plane level.

According to the present invention as described above, it is possible to obtain the smooth flow of the liquid supplied from one supply opening part in a wider range than in a single wing configuration. Hence, it is possible to jet the liquid stably.

A wall surface opposite to the side to which the liquid room is provided in a common liquid room may have a substantially arc configuration or a semicircle configuration in a direction of a line.

According to the present invention as described above, it is possible to flow the liquid from the supply opening part symmetrically, so that it is possible to obtain stable drop jetting.

The supply opening part may be provided at a wall surface side opposite to the side to which the liquid room is provided in the common liquid room, an external side of the wall surface, or an external side of the liquid room being in a direction of a line of the liquid room.

According to the present invention as described above, it is possible to prevent the bubble from being stagnated between the supply opening part and the wall surface.

A plurality of common liquid rooms may be formed in a direction of a line of the liquid rooms independently.

According to the present invention as described above, since the distance between the supply opening part and the liquid room is short, the reduction of the flow speed of the liquid can be reduced. Hence, it is possible to discharge the bubble smoothly and supply the liquid sufficiently at the time of jetting. In addition, since an area of the opening part of one common liquid room is narrow, it is possible to reduce damage or incorrect-connections at the time of assembling so that it is possible to improve a yield rate.

A plurality of the common liquid rooms may be formed in a direction of a line of the liquid rooms independently and the respective common liquid rooms are arranged in parallel.

According to the present invention as described above, it is possible to arrange the supply opening part at an external part of a narrow width part of the neighboring common liquid room. Hence, it is possible to make the capacity of the common liquid room large with a reasonable space.

A plurality of the common liquid rooms may be formed in a direction of a line of the liquid rooms independently and the respective common liquid rooms are arranged line-symmetrically.

According to the present invention as described above, it is possible to supply the liquid from one supply opening part to the independent common liquid room. Furthermore, when a plural line of the nozzles are made, the liquid is supplied from the supply opening part to the common liquid room in the respective lines.

A number of the liquid rooms connected to one of the common liquid room may be in a range of two or more and thirty-two or less.

According to the present invention as described above, it is possible to discharge the bubble accurately.

The respective common liquid rooms and the liquid rooms may have partition walls and a width of the partition wall between the neighboring common liquid rooms has the substantially same length as the width of the partition wall between the neighboring liquid rooms.

According to the present invention as described above, it is possible to maintain the strength of the partition wall so that it is possible to part the common liquid room between the neighboring liquid rooms.

The liquid rooms may make a plurality of lines and the common liquid rooms for the every line of the liquid rooms are provided independently between the respective lines of the liquid rooms.

According to the present invention as described above, it is possible to increase the nozzle density so that it is possible to record with a high quality.

The supply opening part being common for the common liquid rooms for the every line of the liquid rooms may be provided in the common liquid rooms so that the liquid is supplied.

According to the present invention as described above, it is possible to make the structure of liquid drop jet head easily.

The common liquid room may be formed by anisotropic-etching of a silicon substrate.

According to the present invention as described above, it is possible to reduce the cross talk and arrange the liquid room with a high density. Hence, it is possible to record with a high density.

The common liquid room may have a wall surface at a liquid room side of the common liquid room, and the wall surface has a plane configuration having an obtuse angle.

According to the present invention as described above, it is possible to obtain a smooth flow of the liquid and improve the bubble discharge.

The supply opening part may be provided at a surface opposite side to a lid member or a nozzle board forming a wall surface of the liquid room.

According to the present invention as described above, it is possible to make a structure at a surface side near the nozzle easily so that it is possible to miniaturize the jet head.

The supply opening part may be formed by a mechanical process.

According to the present invention as described above, it is possible to select a configuration of the supply opening part widely.

The supply opening part may be formed by anisotropic-etching.

According to the present invention as described above, it is possible to form plural supply opening parts at the same time so that it is possible to reduce the cost.

The pressure generating part may include a vibration board forming the wall surface of the liquid room and an electrode facing the pressure generating part so that the vibration board is deformed by an electrostatic force.

According to the present invention as described above, it is possible to make a high density of the heads easily regardless of the nature of the liquid.

The pressure generating part may include a vibration board forming the wall surface of the liquid room and an electric machine conversion element deforming the vibration board.

According to the present invention as described above, it is possible to make the head regardless of the nature of the liquid.

The pressure generation part may include an electric thermal conversion element arranged in the liquid room.

According to the present invention as described above, it is possible to make the heads of a high density easily.

The liquid drop jet head may be used as an ink jet head, for an ink cartridge in which an ink tank supplying the ink to the ink jet head is unified.

According to the present invention as described above, it is possible to reduce bad jetting due to bubble stagnation so that it is possible to realize operations at low cost.

It is also another object of the present invention to provide an ink jet recording apparatus, comprising an ink jet head jetting the ink drop, the ink jet head includes a nozzle jetting a liquid drop, a liquid room connected to the nozzle, a common liquid room connected to the liquid room, a supply opening part supplying the liquid to the common liquid room, and a pressure generating part which generates a pressure pressurizing the liquid provided in the liquid room, wherein the common liquid room has a configuration in which a width of the common liquid room on a plane level is narrower as a point of the width is more remote from the supply opening part.

According to the present invention as described above, it is possible to obtain a stable operation of the ink drop jet so as to avoid bad jetting. As a result, picture quality improves and the amount of ink absorbed to discharge the bubbles is small. Hence, it is possible to avoid useless consumption of the ink.

Other objects, features, and advantages of the present invention will become more apparent from the following detailed description when read in conjunction with the accompanying drawings.

DETAILED DESCRIPTION OF THE PREFERRED EMBODIMENTS

A description will now be given, with reference to the FIGS. 2 through 22, of embodiments of the present invention.

Figure 2:
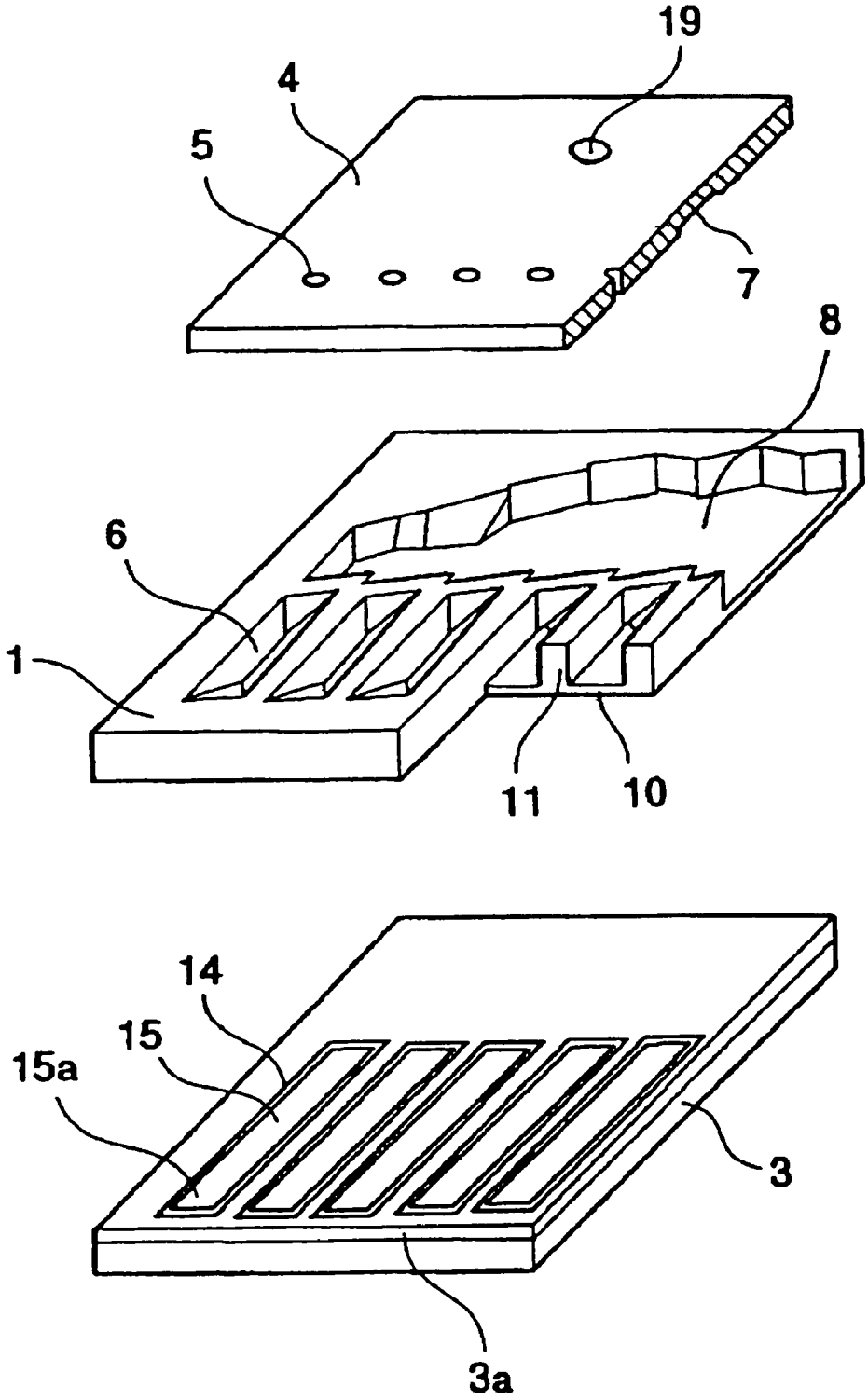
FIG. 2 is an exploded and perspective view of an ink jet head as a liquid drop jet head of a first embodiment according to the present invention.
Figure 3:
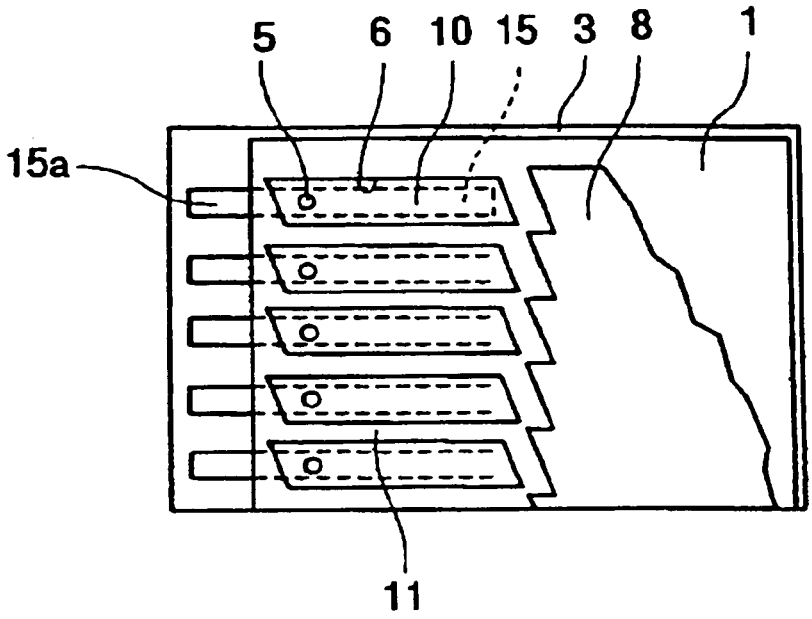
FIG. 3 is a plan view of a nozzle board of the ink jet head shown in FIG. 2 in a permeation state.
Figure 4:
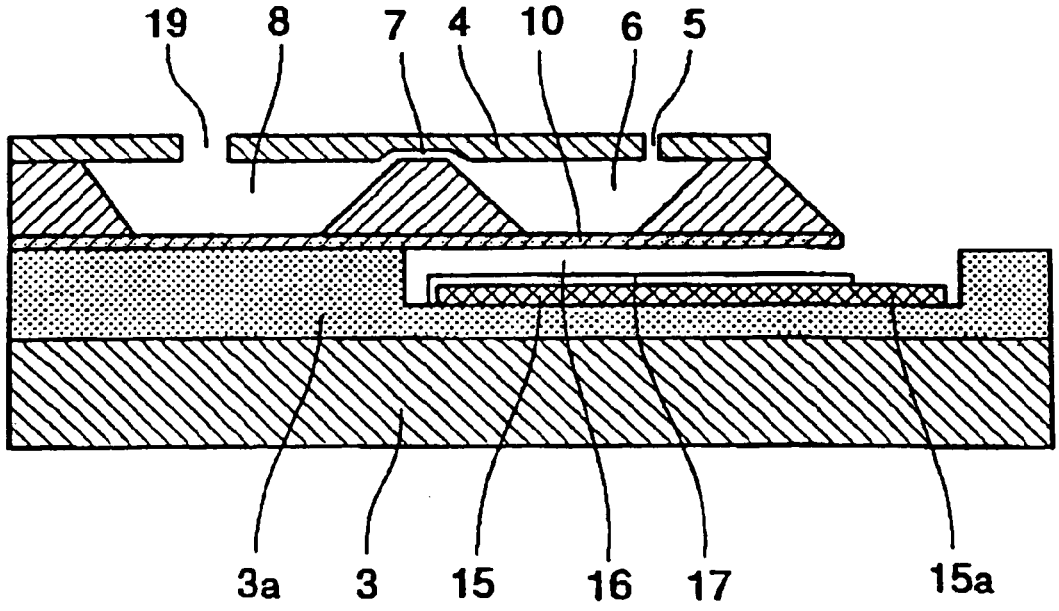
FIG. 4 is a roughly sectional view taken along a long axis of a liquid room in the ink jet head shown in FIG. 2.
Figure 5:
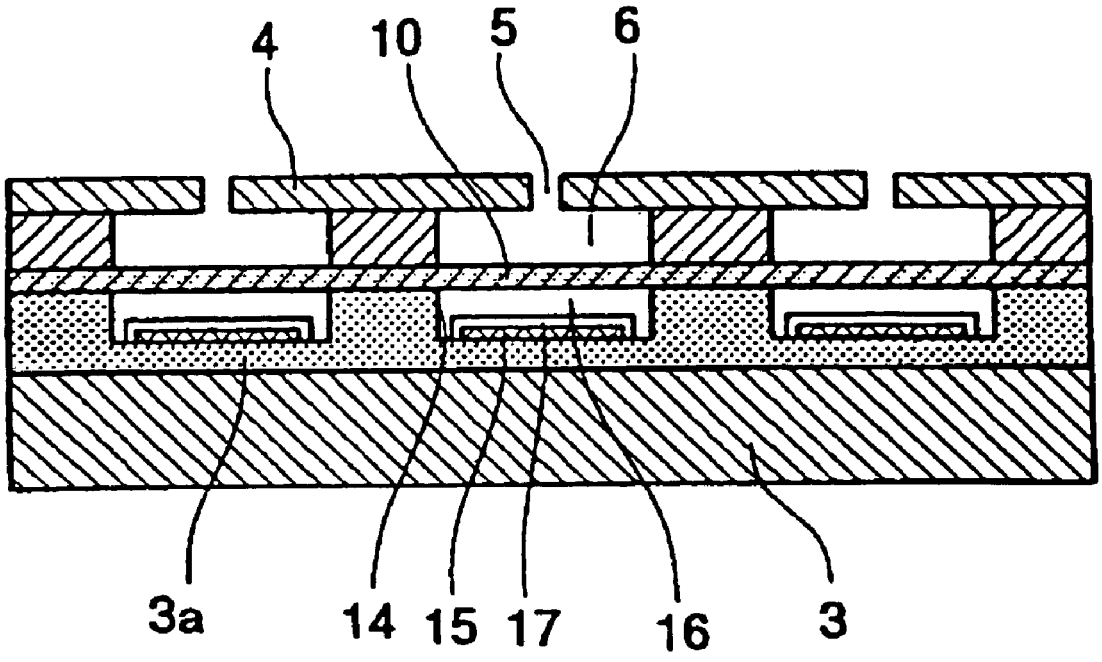
FIG. 5 is a roughly sectional view taken along a short axis of the liquid room in the ink jet head shown in FIG. 2.
Figure 6:
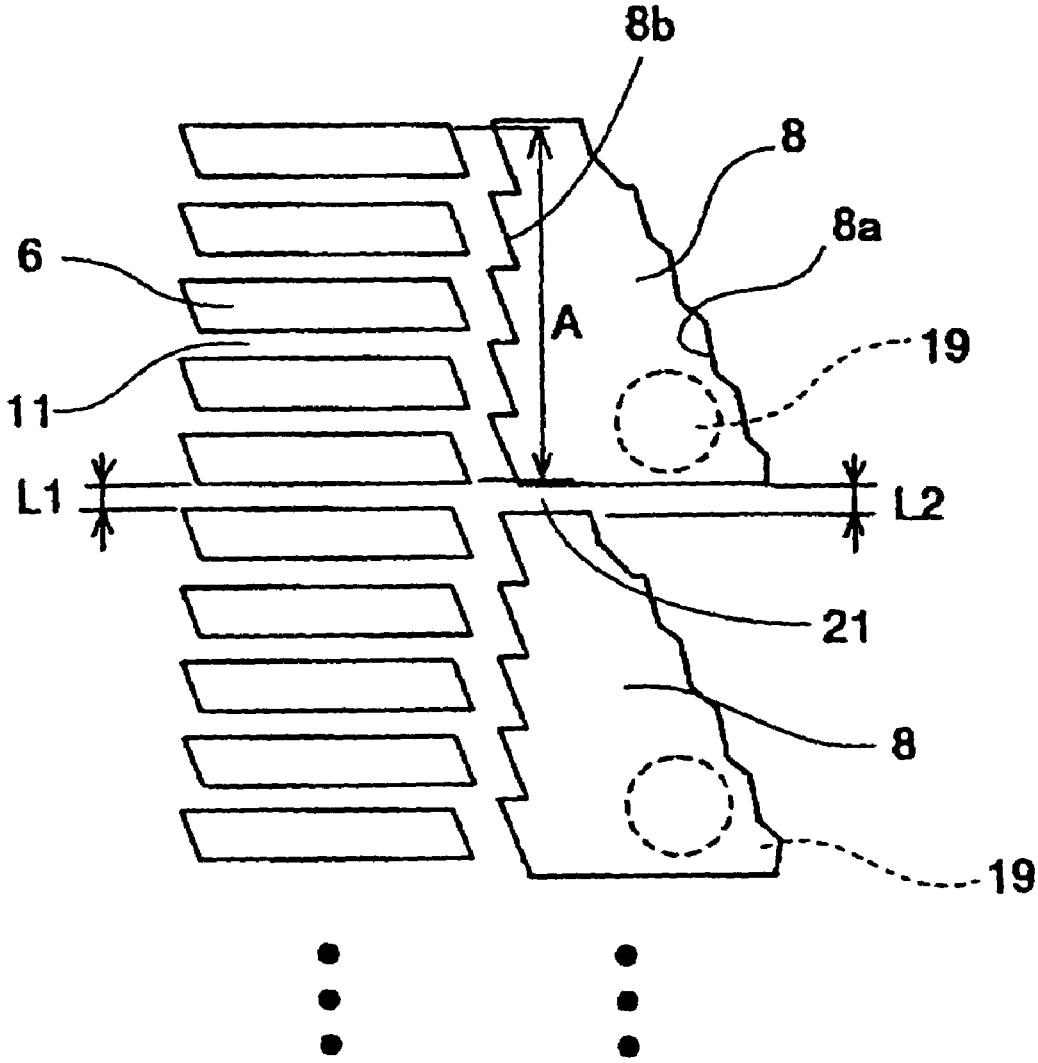
FIG. 6 is a plan view for explaining a configuration of the liquid room in the ink jet head shown in FIG. 2.

FIG. 2 is an exploded and perspective view of an ink jet head as a liquid drop jet head of a first embodiment according to the present invention. FIG. 3 is a plan view of a nozzle board of the ink jet head shown in FIG. 2 in a permeation state. FIG. 4 is a roughly sectional view taken along a long axis of a liquid room in the ink jet head shown in FIG. 2. FIG. 5 is a roughly sectional view taken along a short axis of the liquid room in the ink jet head shown in FIG. 2. FIG. 6 is a plan view for explaining a configuration of the liquid room in the ink jet head shown in FIG. 2;

Referring to FIGS. 2 through 5, the ink jet head is made up of a multi-layer structure body. A channel substrate 1 as a first substrate, an electrode substrate 3 as a second substrate, and a nozzle board 4 as a third substrate are stacked and connected respectively in the multi-layer structure body. The electrode substrate 3 is provided at a lower side of the channel substrate 1. The nozzle board 4 is provided at an upper side of the channel substrate 1. In the multi-layer structure body, plural nozzles 5 are connected to a liquid room 6 as an ink channel. In addition, a common liquid room 8 is connected to the liquid room 6 by a fluid resister part 7.

The liquid room 6, a vibration board 10, and a concave part forming a partition wall 11 separating adjacent liquid rooms 6, and another concave part forming the common liquid room 8 are formed in the channel substrate 1. The vibration board 10 forms a wall surface to form a bottom part of the liquid room 6.

In order to obtain the channel substrate 1, first, boron that is a high density impurity is diffused in a single crystal silicon substrate (silicon wafer) having a surface direction of (110), so that a high density boron dope layer having a thickness (depth) of the vibration board 10 is obtained. Next, anisotropic-etching of the silicon substrate is implemented by using the high density boron dope layer as an etching stop layer, so that the vibration board 10 having a desirable thickness is obtained when a concave part, namely the liquid room 6, is formed. As a high density p-type impurity, not only boron but also gallium, aluminum, or others can be used. In addition, an atom having a larger lattice constant than silicon, for example germanium, can be included to the high density boron dope layer.

Furthermore, a silicon on insulator (SOI) board in which a base substrate is connected to an active layer substrate by an oxide film can be used as the channel substrate 1. In this case, the active layer substrate is used as the vibration board 10, and concave parts forming the liquid rooms 6 and the common liquid room 10 are dug into the base substrate.

A concave part 14 is formed in the electrode substrate 3. An electrode 15 is formed on a bottom surface of the concave part 14. The electrode 15 faces the vibration board 10 with a gap 16 having a designated length. An actuator part is comprised of the electrode 15 and the vibration board 10. In the actuator part, the internal capacity of the liquid room 6 is changed by modifying the vibration board 10 with an electrostatic force. In order to prevent the electrode 15 from being damaged due to a connection to the vibration board 10, an insulating layer 17 such as $SiO_2$ having a thickness of 0.1 μm is deposited on the electrode 15 of the electrode substrate 3. The electrode 15 is extended to a vicinity of an end part of the electrode substrate 3, so that an electrode pad part 15*a* for connecting to an external driving circuit with a connecting means is formed.

The concave part 14 of the electrode substrate 3 is formed on a single crystal silicon substrate wherein a thermal oxide film 3*a* is formed on a surface of the single crystal silicon substrate or a glass substrate, by etching with an HF solution. A film having a desirable thickness of an electrode material having a high heat-resistance such as titanium nitride is deposited in the concave part 14 by a deposition technology such as sputtering, a chemical vapor deposition (CVD) method, or other vapor deposition methods. After the deposition, a photo resist is formed and an etching process is implemented, so that the electrode 15 is formed in only the concave part 14. The electrode substrate 3 and the channel substrate 1 are connected by an anode connection and a direct connection, for example.

A multi layer structure of tungsten silicide and a polysilicon film for example, or polycrystalline silicon film can be applied to the electrode 15. The polycrystalline silicon film is obtained by doping gold, a metal material generally used for a forming process of a semiconductor element such as aluminum, chromium, or nickel, a metal having a high melting point such as titanium or titanium nitride, or impurities.

In this embodiment, the concave part 14 having a depth of 0.4 μm is formed on the silicon substrate by etching. The titanium nitride having a thickness of 0.1 μm is formed in the concave part 14 by sputtering. A $SiO_2$ sputter film having a thickness of 0.1 μm, as the insulating layer 17, is formed on the titanium nitride. Therefore, the gap 16 between the vibration board 10 and a surface of the insulating layer 17 has a length of 0.2 μm after the electrode substrate 3 is connected to the channel substrate 1.

The nozzle 5, a groove for as the fluid resister part 7, and an ink supply opening part 19 for supplying the ink from outside to the common liquid room 8 are formed at the nozzle board 4. A jet surface of the nozzle board 4 is repellent-processed. For example, a plating film formed by an Ni electroforming method, a silicon substrate, a metal such as SUS, or a plural layer structure of a resin and a metal layer such as zirconia can be used as the nozzle board 4. The nozzle board 4 is connected to the channel substrate 1 by an adhesive.

Figure 1:
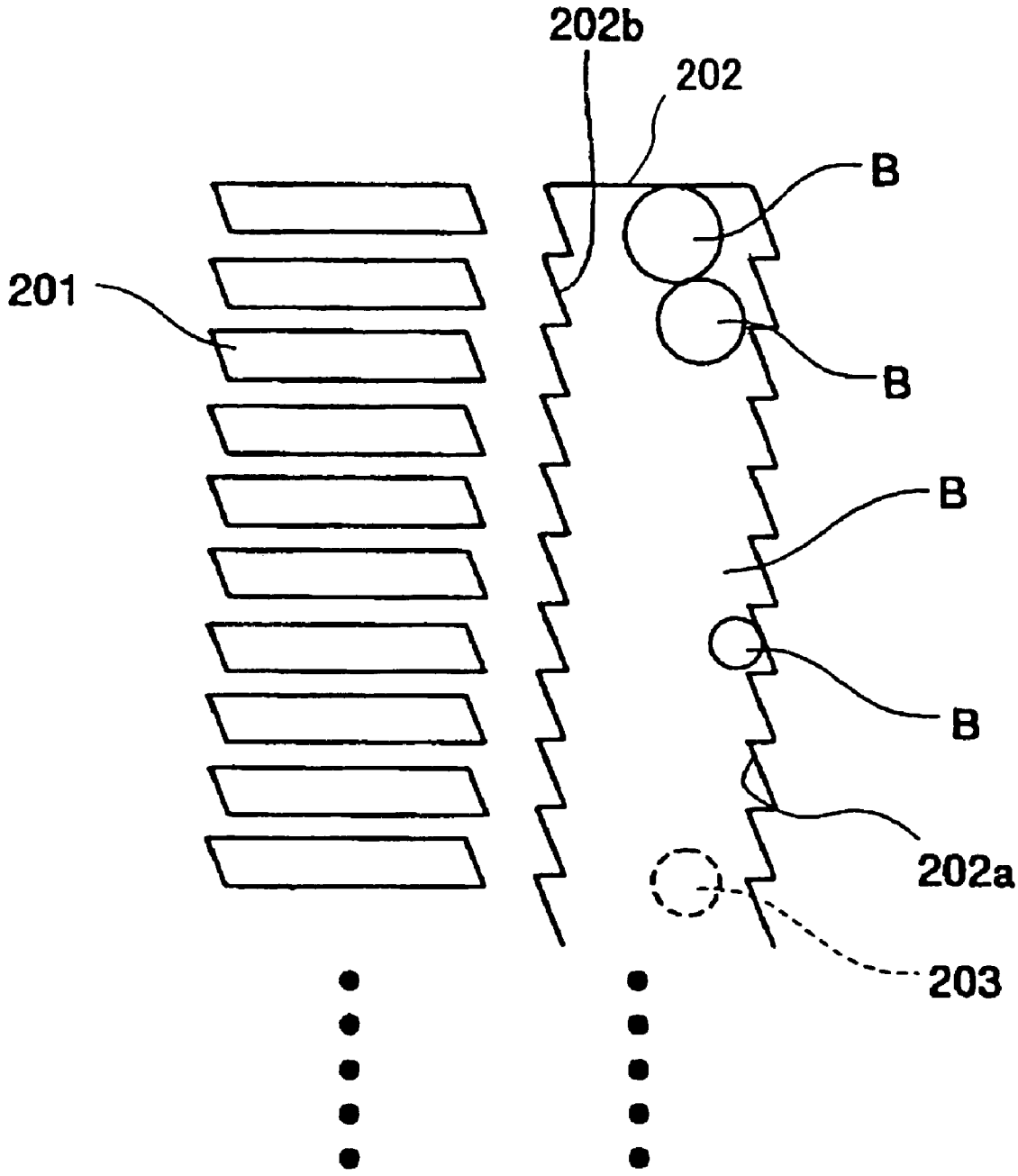
FIG.1 RELATED ART
FIG. 1 is a plan view for explaining a configuration of a liquid room of a related art ink jet head.

Referring to FIG. 6, a configuration of the liquid room 6 in the ink jet head shown in FIG. 1 will be described.

The single crystal silicon substrate (silicon wafer) having a surface direction of (110) is anisotropically etched as the channel substrate 1, so that the plural liquid rooms 6 are formed as shown in FIG. 6. In addition, the plural common liquid rooms 8 which are connected to a designated number of the liquid rooms 6. That is, the plural and independent common liquid rooms 8 are formed in a direction of a line of the liquid rooms 6. The ink supply opening parts 19 to supply the ink from outside to the respective common rooms 8 are formed.

Thus, each of the plural common liquid rooms 8 for supplying the ink to the respective liquid rooms 6 is provided divisionally in the direction of the line of the liquid rooms 6. Since the ink supply opening parts 19 are provided respectively in the common liquid rooms 8, a distance between the ink supply opening part 19 and a liquid room 6 is short. Therefore, a reduction of the speed of the ink due to an obstacle to ink flow at a wall surface of the common liquid room 8 having the saw teeth configuration formed by the anisotropic-etching is reduced. As a result, the bubble discharge is improved. Furthermore, since an opening area of the common liquid room 8 is small, the strength of the ink jet head is improved so that the damage to the ink jet head during assembling can be reduced, and the damage and the incorrect-connection of the nozzle board 4 can be reduced.

One of the common liquid rooms 8 has an area A in the line direction of the corresponding liquid room 6 to the common liquid room 8. The area A has a configuration wherein a width crossing at right angles with the line direction of the corresponding liquid room 6 is narrower consecutively as the rectangular point is more remote from the ink supply opening part 19. That is, the common liquid room 8 has a single wing configuration, and the ink supply opening part 19 is provided at a base point of the single wing configuration.

Thus, the width of the common liquid room 8 is narrower as a position of the width is more remote from the ink supply opening part 19. Therefore, even if a flow amount of the ink supplied to the position is small because the position is remote from the ink supply opening part 19, the speed of the ink is prevented from being reduced and thereby the bubble discharge improves.

In addition, each of the plural common liquid rooms 8 is provided divisionally in the direction of the line of the liquid rooms 6. The width of the common liquid room 8 is narrower as the point of the width is more remote from the ink supply opening part 19. Hence, even if the number of nozzles increases, bubble discharge can be maintained. In a case where the common liquid rooms 8 are not divided but the width of the common liquid room is narrower as the point of the width is more remote from the ink supply opening part, bubbles can be discharged well when the number of jet rooms (number of nozzles) being used is small. However, in this case, it may not be possible to discharge bubbles when the number of the jet rooms being used increases to realize a high speed recording. The above mentioned problem can be solved by the present invention.

Since the ink supply opening part 19 is arranged at the side of the wall surface 8*a* opposite to the side of liquid room 6 in the common liquid room 8, a smooth flow of the ink can be obtained so that a ratio of the bubble discharge improves.

Furthermore, since the wall surface 8*b* situated at the side of liquid room 6 in the common liquid room 8 is anisotropically etched, the wall surface 8*b* has the configuration of the saw teeth having acute angles on a plane level. On the other hand, the wall surface 8*a* opposite to the side of liquid room 6 in the common liquid room 8 has a configuration of an obtuse angle, namely a configuration not having the acute angle. Hence, ink flow from the ink supply opening part 19 is not obstructed by the wall surface 8*b* so that the speed of the ink is not reduced and the smooth flow of the ink can be obtained. Therefore, stagnation of the ink flow can be reduced.

As described above, the wall surface 8*b* situated at the side of liquid room 6 in the common liquid room 8 has the configuration of the saw teeth on a plane level. Hence, taking a microscopic view, the width of the common liquid room 8 is not narrower as the point of the width is more remote from the ink supply opening part 19. Rather, the width of the common liquid room 8 may be wider at a point based on a degree of inclination of the saw teeth part of the wall surface 8*a*. However, the present invention can be applied to the wall surface 8*a* having this discrete wide part. That is, even if the width of the common liquid room 8 may be wider at a point taking a microscopic view, the width of the common liquid room 8 is narrower as the point of the width is more remote from the ink supply opening part 19 as a whole, taking a macro view. In other words, in this specification, "the width of the common liquid room 8 is narrower as the point of the width is more remote from the ink supply opening part 19" includes "the width of the common liquid room 8 may be wider at a point based on the degree of inclination of the saw teeth part of the wall surface 8*a*".

Furthermore, a width L2 of a partition wall 21 between the neighboring common liquid rooms 8 has the substantially same length as a width L1 of a partition wall 11 between the neighboring liquid rooms 6. Hence, it is possible to obtain a high strength of the partition wall 21 between the neighboring common liquid rooms 8 and thereby the common liquid room 8 can be kept separate as the neighboring liquid rooms 6 are kept separate.

Figure 7:
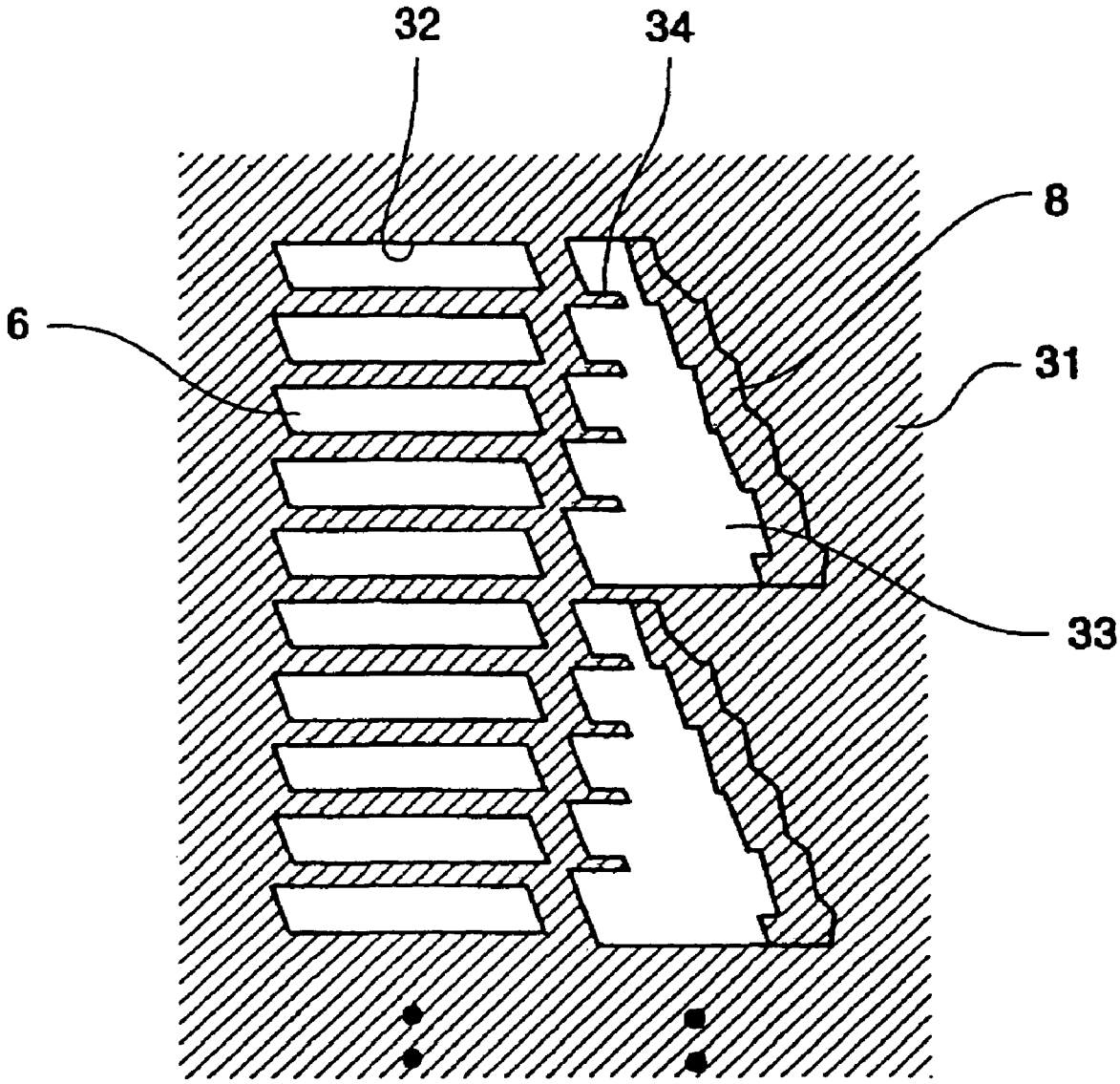
FIG. 7 is a plan view for explaining a manufacturing method of the liquid room in the ink jet head shown in FIG. 2.

Next, a manufacturing method of the configuration of the common liquid room 8 will be described with reference to FIG. 7. FIG. 7 is a plan view for explaining a manufacturing method of the liquid room in the ink jet head shown in FIG. 2. Referring to FIG. 7, a mask layer (mask pattern) of an etching liquid having an alkali resistance such as a silicon nitride film or a silicon oxide film is formed on the silicon wafer of a surface direction of (110), namely the channel substrate. An opening part 32 corresponding to the liquid room 6 and the opening part 33 corresponding to the common liquid room 8 are formed in the mask layer 31. In this case, a compensation pattern 34 is formed in the opening part 33 corresponding to the common liquid room 8.

After that, the silicon wafer is anisotropically etched by an alkali liquid such as a potassium hydroxide water liquid, tetramethylammonium hydroxide (TMAH), or EDP, the etching improves to a horizontal direction other than an area surrounded by a surface having a low etching rate of (111). As a result, etching improves to the compensation pattern 34. On the other hand, since the etching at the side of the wall surface 8*a* of the common liquid room 8 improves, it is possible to obtain the common liquid room 8 having a configuration of the saw teeth having acute angles of the side of the wall surface 8*b* and a configuration of obtuse angles of the side of the wall surface 8*a*. Since the mask pattern described above is one of examples, the mask pattern is formed based on the etching liquid and the etching depth.

Figure 8:
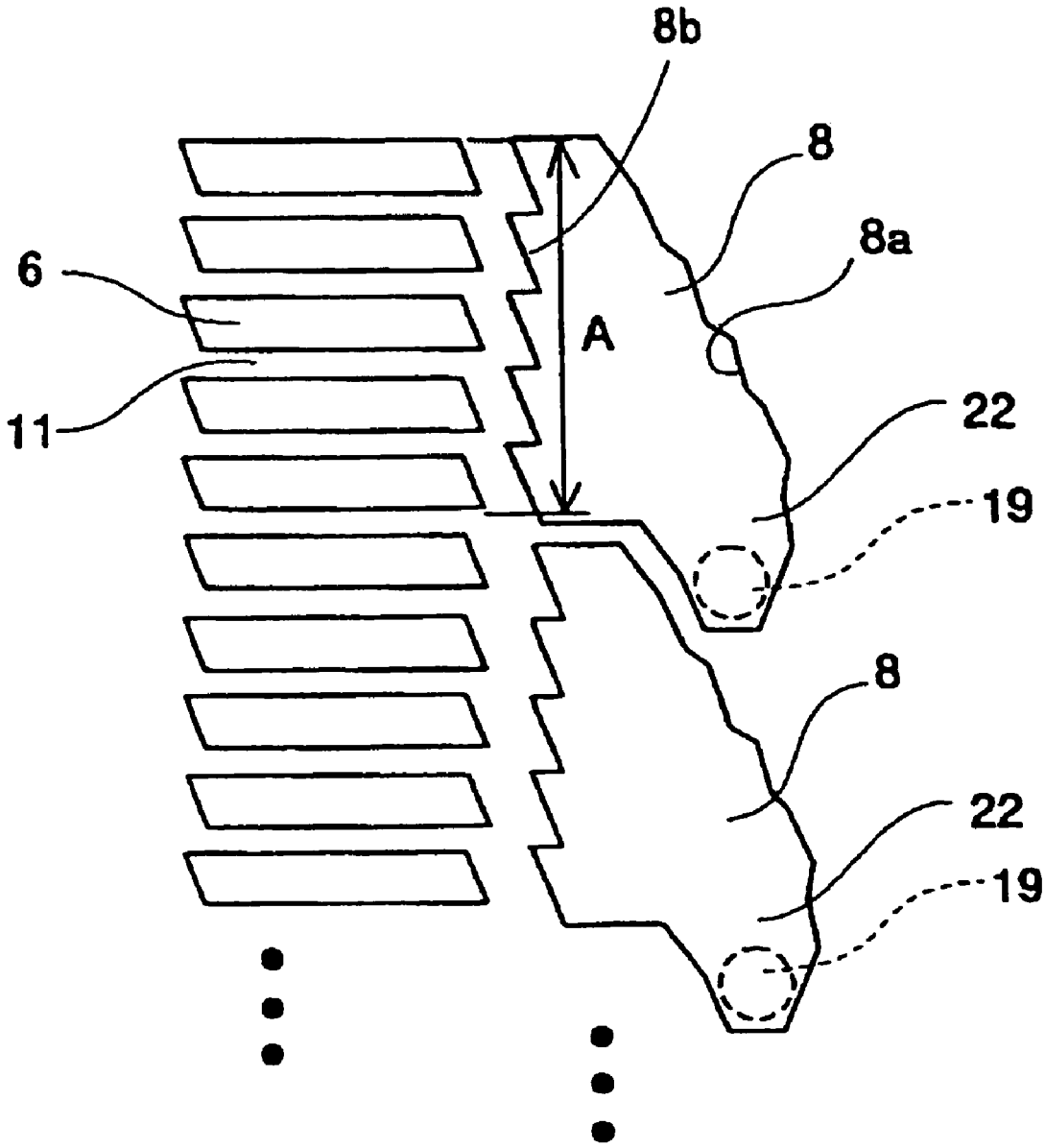
FIG. 8 is a plan view for explaining a configuration of a liquid room in an ink jet head of a second embodiment according to the present invention.

Next, an ink jet head of a second embodiment of the present invention will be described with reference to FIG. 8. FIG. 8 is a plan view for explaining a configuration of the liquid room in the ink jet head of the second embodiment according to the present invention.

In this embodiment, an ink channel 22 is provided at an extended part of a wide width part in the common liquid room 8 in the vicinity of a narrow width part of a neighboring common liquid room 8. The ink supply opening part 19 is provided in the ink channel 22.

Thus, since the ink channel 22 is provided at the extended part from the wide width part in the common liquid room 8 to the vicinity of the narrow width part of a neighboring common liquid room 8, increasing the ink jet head area is avoided. In addition, it is possible in this embodiment to increase the capacity of the common liquid room 8 compared to the first embodiment. As a result, the ink can be supplied to the liquid room 6 accurately.

Figure 9:
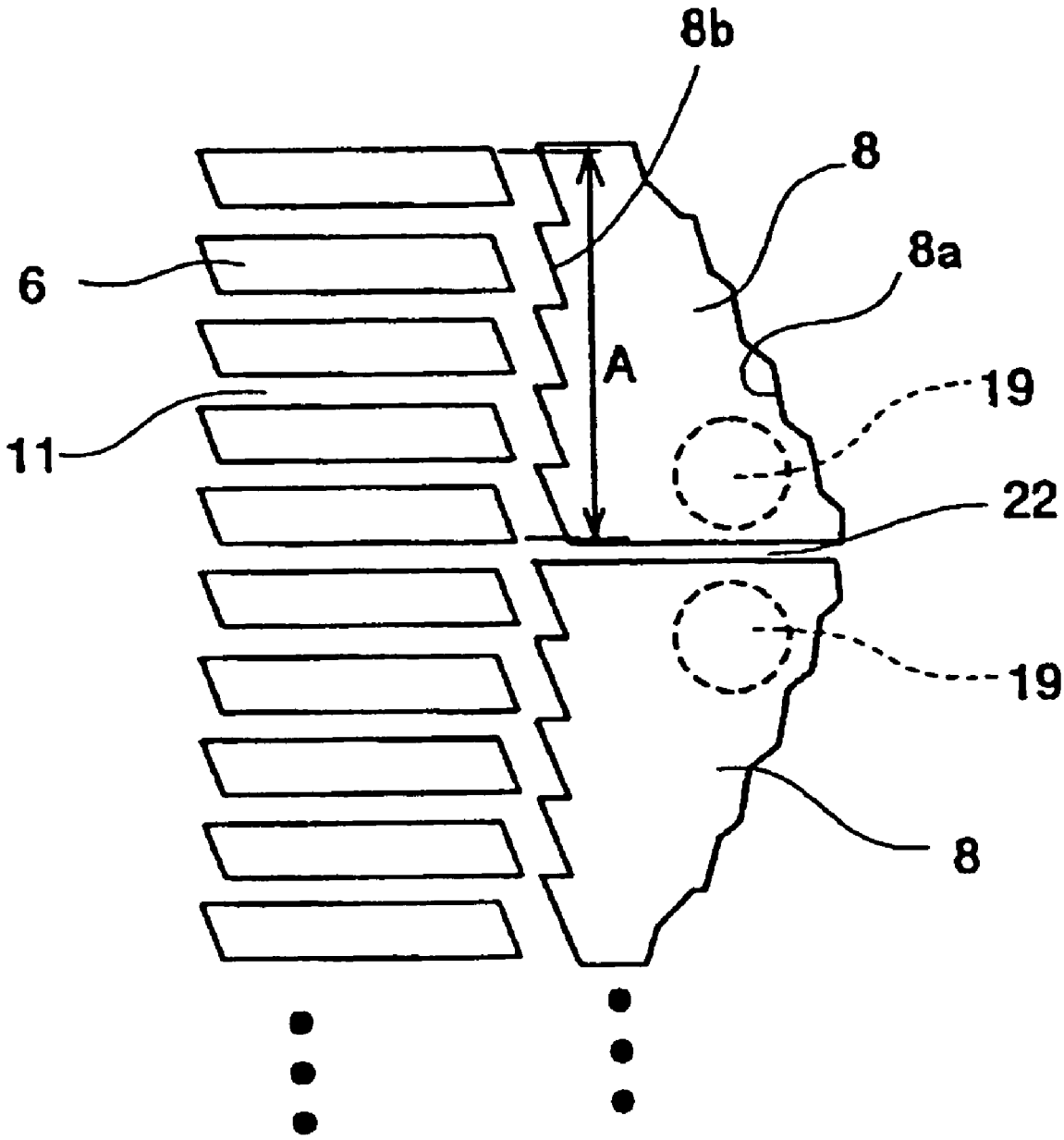
FIG. 9 is a plan view for explaining a configuration of a liquid room in an ink jet head of a third embodiment according to the present invention.

Next, an ink jet head of a third embodiment of the present invention will be described with reference to FIG. 9. FIG. 9 is a plan view for explaining a configuration of the liquid room in the ink jet head of the third embodiment according to the present invention.

In this embodiment, two of the common liquid rooms 8 are arranged line-symmetrically with respect to the ink channel 22.

It is possible in this embodiment to obtain the same effect as in the first embodiment. In addition, it is possible to bring the ink supply opening part 19 in the common liquid room 8 close to another ink supply opening part 19 in the neighboring common liquid room 8. As a result, it is possible to make a configuration combining the ink supply opening parts 19 situated at two of the common liquid rooms 8 while maintaining independence of the two common liquid rooms 8.

Figure 10:
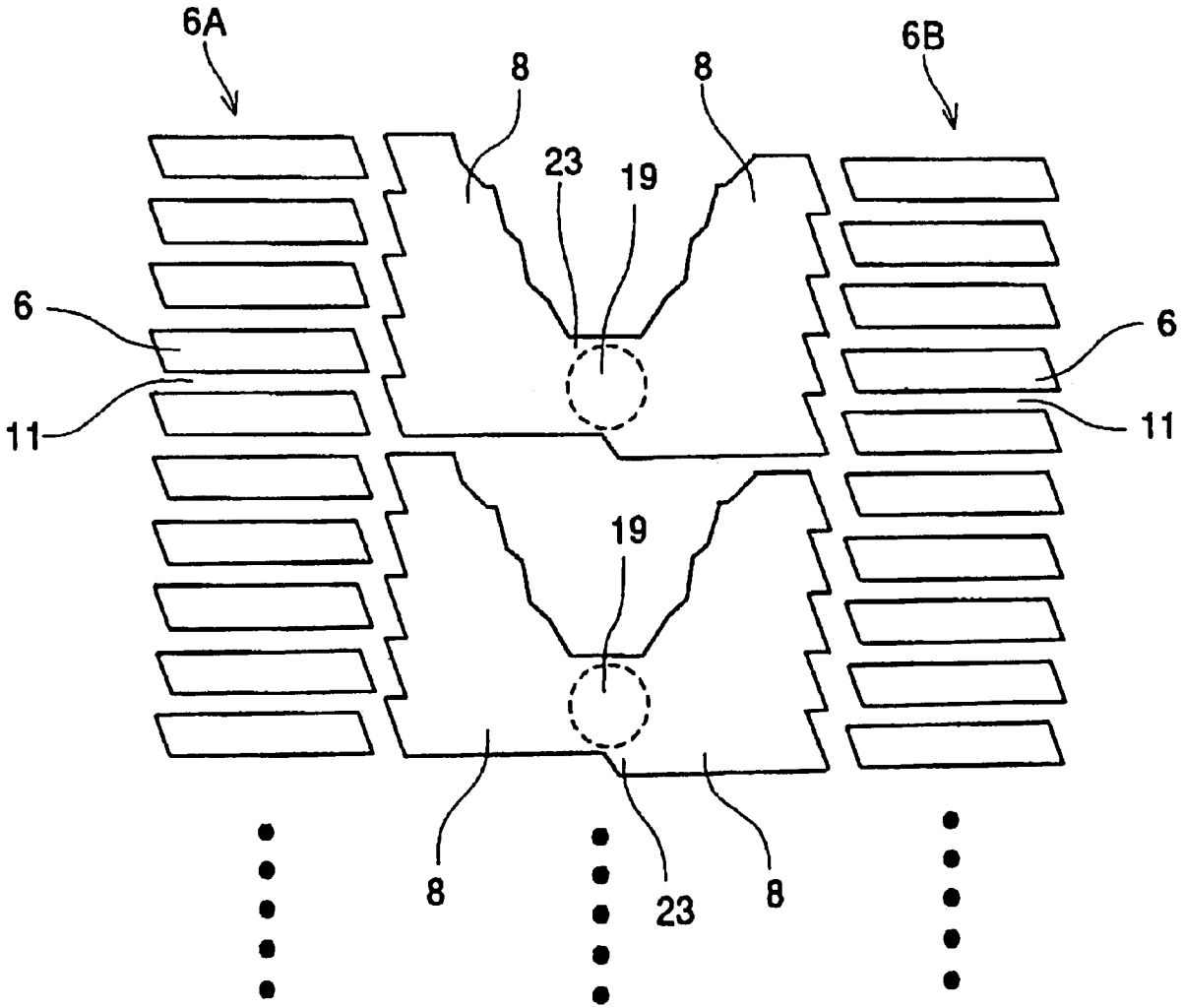
FIG. 10 is a plan view for explaining a configuration of a liquid room in an ink jet head of a fourth embodiment according to the present invention.

Next, an ink jet head of a fourth embodiment of the present invention will be described with reference to FIG. 10. FIG. 10 is a plan view for explaining a configuration of the liquid rooms in the ink jet head of the fourth embodiment according to the present invention.

In this embodiment, two lines of the liquid rooms 6 are arranged, namely two lines of the nozzles 5 are arranged, so that the lines of liquid rooms 6A and 6B are arranged zigzag to each other. The respective common liquid rooms 8 are provided in a direction of a line of the liquid rooms 6 between the lines of liquid rooms 6A and 6B. Furthermore, an ink channel 23 connected to the common liquid rooms 8 neighboring each other is arranged between the lines of liquid rooms 6A and 6B. The ink supply opening part 19 is arranged in the ink channel 23.

According to a structure of the ink jet head in this embodiment, even if a number of the nozzles increases, it is possible to supply the ink from the ink supply opening part 19 to the left and right common liquid room 8 so that the structure of the ink jet head can be made easily.

Figure 11:
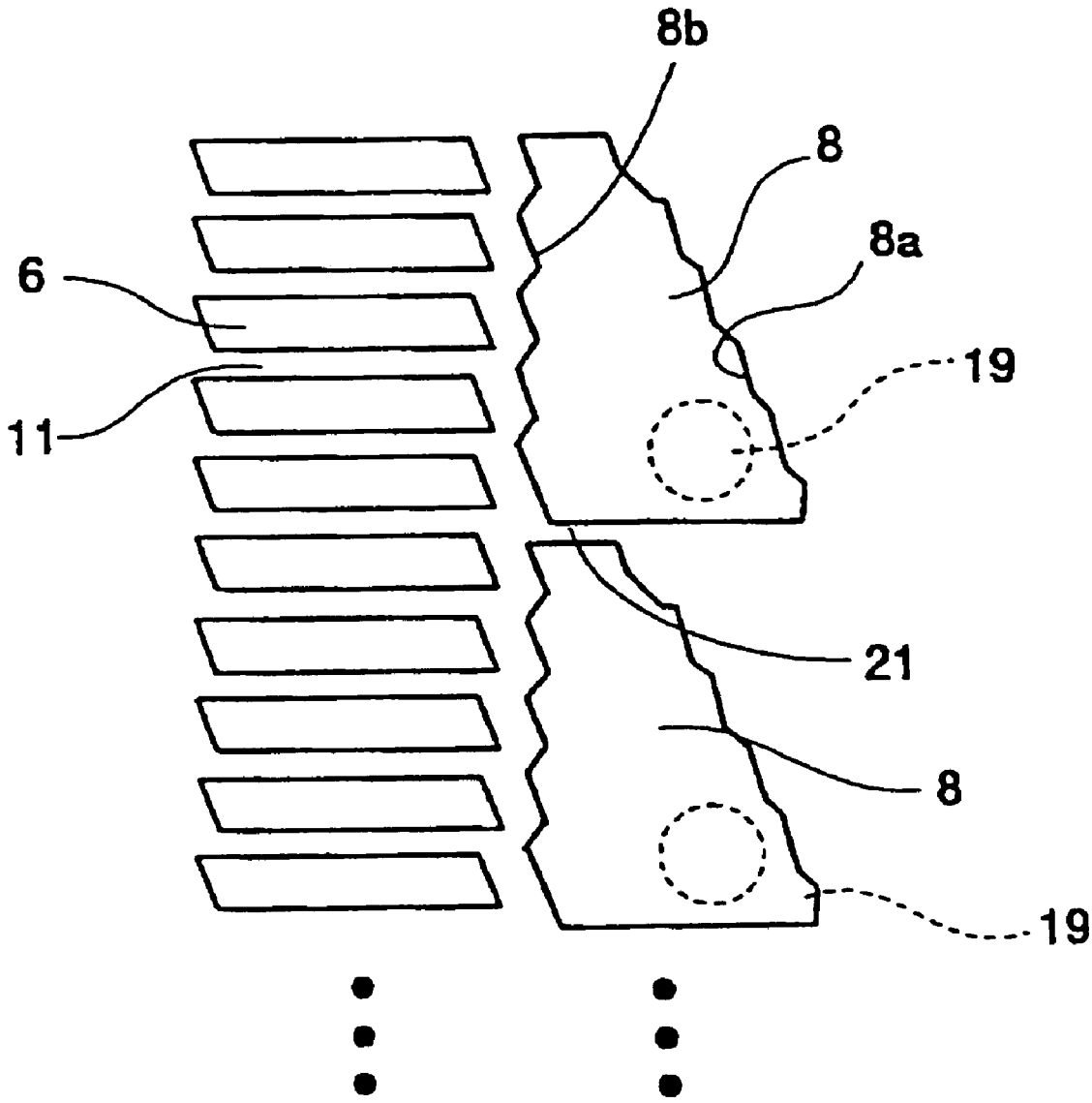
FIG. 11 is a plan view for explaining a configuration of the liquid room in the ink jet head of a fifth embodiment according to the present invention.

Next, an ink jet head of a fifth embodiment of the present invention will be described with reference to FIG. 11. FIG. 11 is a plan view for explaining a configuration of the liquid room in the ink jet head of the fifth embodiment according to the present invention.

In this embodiment, the wall surface 8*b* situated at the side of liquid room 6 in the common liquid room 8 has a configuration having obtuse angles on a plane level, namely a configuration of saw teeth not having acute angles on a plane level.

In order to form the configuration of the wall surface 8*b* having the obtuse angles on a plane level, the mask layer (mask pattern) 31 for anisotropically etching as shown in FIG. 7 is used. The anisotropically etching does not stop when the configuration of the wall surface 8*b* shown in the first embodiment of the present invention is formed. Rather, the anisotropic-etching continues five through ten minutes more. Thus, the configuration of the wall surface 8*b* is made smooth by etching the acute angles gradually. In this case, since the wall surface 8*a* situated at an opposite side to the side of liquid room 6 in the common liquid room 8 is also etched, a width of the common liquid room 8 becomes wider. Therefore, when it is desirable to form the width of the common liquid room 8 shown in FIG. 7, the mask layer (mask pattern) designed with a consideration of an increase of the etching may be used.

Because of this, even if the common liquid room 8 is formed by anisotropic-etching of the silicon substrate, the wall surface does not have the configuration of the saw teeth having acute angles on a plane level based on anisotropic-etching. Therefore, an obstacle to the ink flow or a generation of a whirlpool is reduced so that further smooth ink flow can be obtained. Accordingly, stagnation of the bubble can be reduced so that the ink supply at the time of ink jetting is secured sufficiently and it is possible to realize a high speed recording in a state of the high frequency driving.

Figure 12:
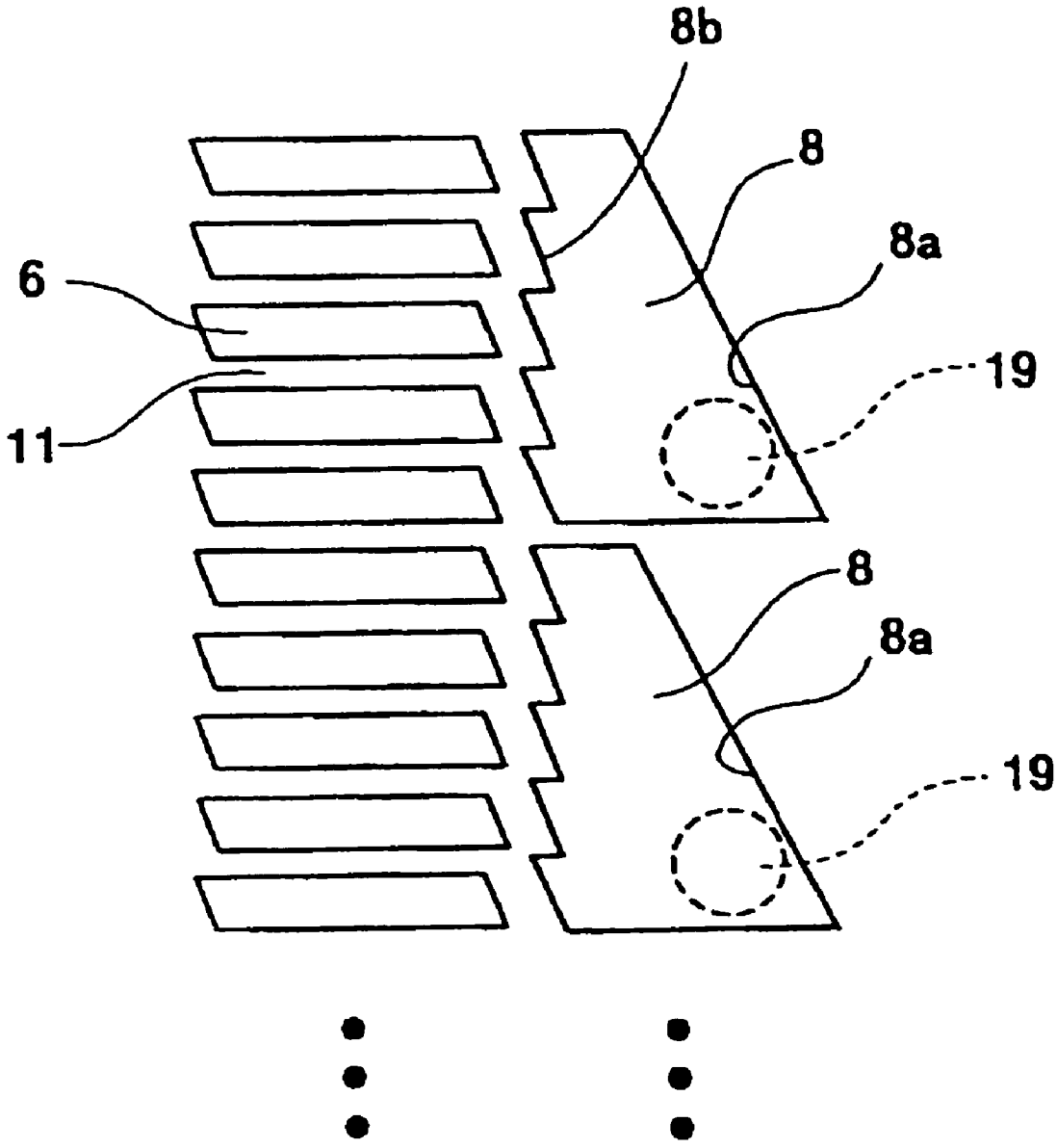
FIG. 12 is a plan view for explaining a configuration of a liquid room in an ink jet head of a sixth embodiment according to the present invention.

Next, an ink jet head of a sixth embodiment of the present invention will be described with reference to FIG. 12. FIG. 12 is a plan view for explaining a configuration of a liquid room in an ink jet head of a sixth embodiment according to the present invention.

In this embodiment, the wall surface 8*a* situated at the opposite side to the side of liquid room 6 in the common liquid room 8 has a linear configuration. Accordingly, it is possible to secure a further smooth ink flow and improve the bubble discharge.

Figure 13:
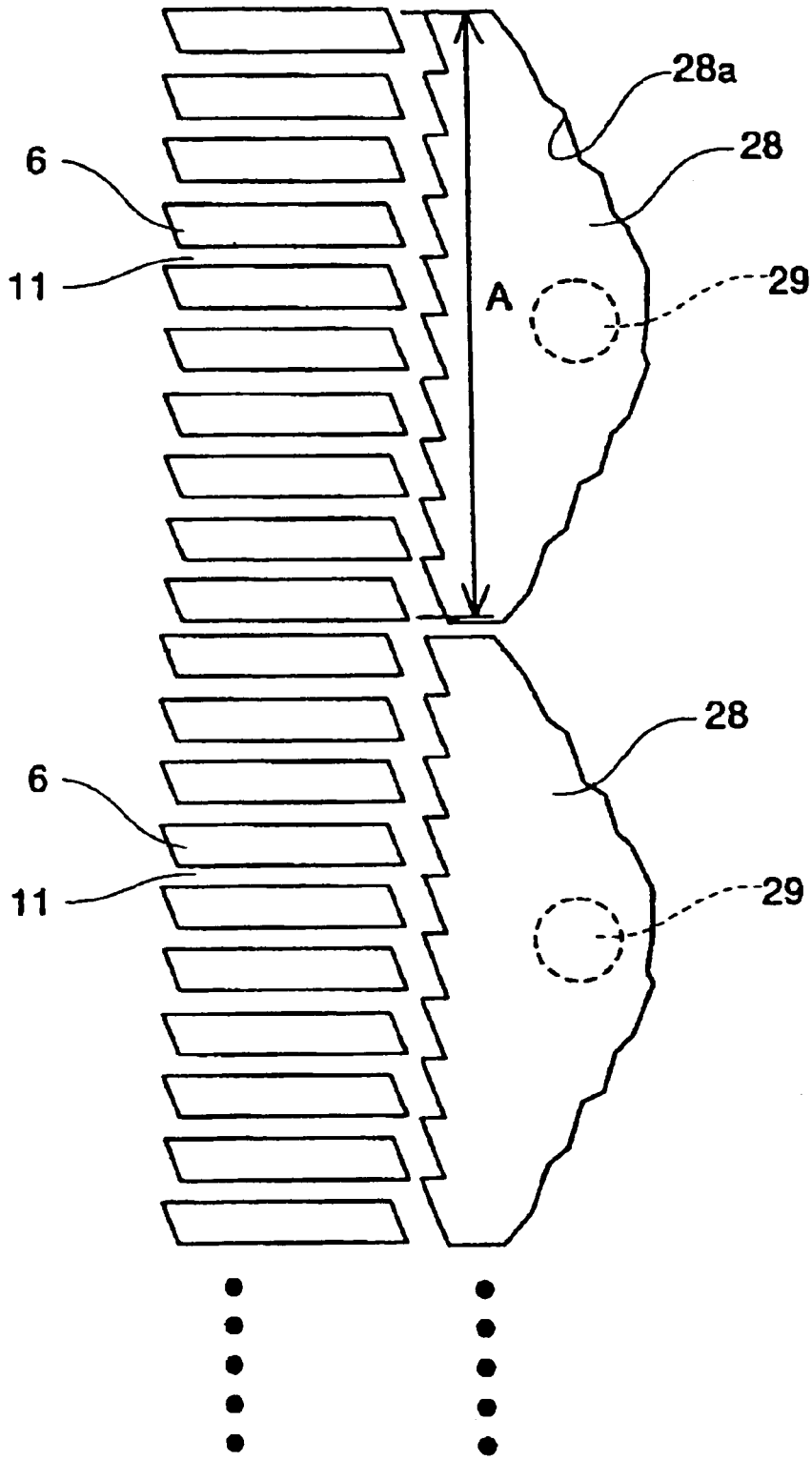
FIG. 13 is a plan view for explaining a configuration of a liquid room in an ink jet head of a seventh embodiment according to the present invention.

Next, an ink jet head of a seventh embodiment of the present invention will be described with reference to FIG. 13. FIG. 13 is a plan view for explaining a configuration of a liquid room in an ink jet head of a seventh embodiment according to the present invention.

In this embodiment, the plural common liquid rooms 28 are arranged in a direction of a line of the liquid rooms 6. Each of the common liquid rooms 8 has an area A in a line direction of the corresponding liquid rooms 6 to the common liquid rooms 8. The area A has a configuration wherein a width crossing at right angles with the line direction of the corresponding liquid room 6 is narrower consecutively as the rectangular point is more remote from the ink supply opening part 29 to both ends. That is, the common liquid room 8 has a dual wings configuration, and the ink supply opening part 29 is provided at a base point of the dual wings configuration of the common liquid room 28.

In this embodiment, the wall surface 28*a* situated at the opposite side to the side of liquid room 6 in the common liquid room 28 has an approximately arc configuration on a plane level. The wall surface 28*a* may have a semicircle configuration although the wall surface 28*a* has a configuration of some corners due to anisotropically etching similar to the common liquid room 8 of the first embodiment of the present invention.

Thus, the plural common liquid rooms 28 for supplying the ink to plural liquid rooms 6 are arranged divisionally in a direction of a line of the liquid rooms 6. In addition, the ink supply opening parts 29 are provided at the respective common liquid rooms 28. Hence, a distance between the ink supply opening part 29 and a liquid room 6 is short. It is possible to prevent the speed of the ink from being reduced due to a configuration of saw teeth having acute angles on a plane level formed by anisotropically-etching. As a result, the bubble discharge can improve. Furthermore, since the opening area of the common liquid room 8 is small, the strength of the ink jet head is improved so that damage to the ink jet head during assembling the ink jet head can be reduced and the damage and the incorrect connection of the nozzle boards 4 can be reduced.

In addition, the width of the common liquid room 28 is narrower as a position of the width is more remote from the ink supply opening part 29. Therefore, even if a flow amount of the ink supplied to the position is small because the position is remote from the ink supply opening part 29, the speed of the ink is prevented from being reduced and thereby the bubble discharge improves.

In this case, the ink supply opening part 29 is provided in a direction of a line of the liquid rooms 6 and in the approximately center part of the common liquid room 28. The ink flow is formed symmetrically to the liquid rooms 6 situated in the at vicinity of the end parts of the common liquid room 28. As a result, it is possible to jet an ink drop stably. Furthermore, plural common liquid rooms 28 are divided in a direction of a line of the liquid rooms 6. Also, a width crossing at right angles with the line direction of the corresponding liquid rooms 6 is narrower consecutively as a rectangular point on the width is more remote from the ink supply opening part 29 to both ends. As a result, the distance between the ink supply opening part 29 and the respective liquid rooms 6 is short and thereby the amount of jetting and the speed of the ink between the nozzles 5 are also reduced.

The ink supply opening part 29 is provided at a side of the wall surface 28*a* situated opposite to the side of liquid rooms 6 in the common liquid room 28, namely at a close position to the wall surface 28*a* situated opposite to the side of liquid rooms 6 in the common liquid room 28. As a result, it is possible to secure a smooth ink flow. Therefore, it is preferable to provide the ink supply opening part 29 at a position closer to the side of the wall surface 28*a* (arc side) than the center of a width direction of the common liquid room 8. If the ink supply opening part 29 is remote from the arc side, stagnation of the ink in the vicinity of the arc (wall surface 28*a*) is apt to occur and thereby the bubble may be not discharged.

Figure 14:
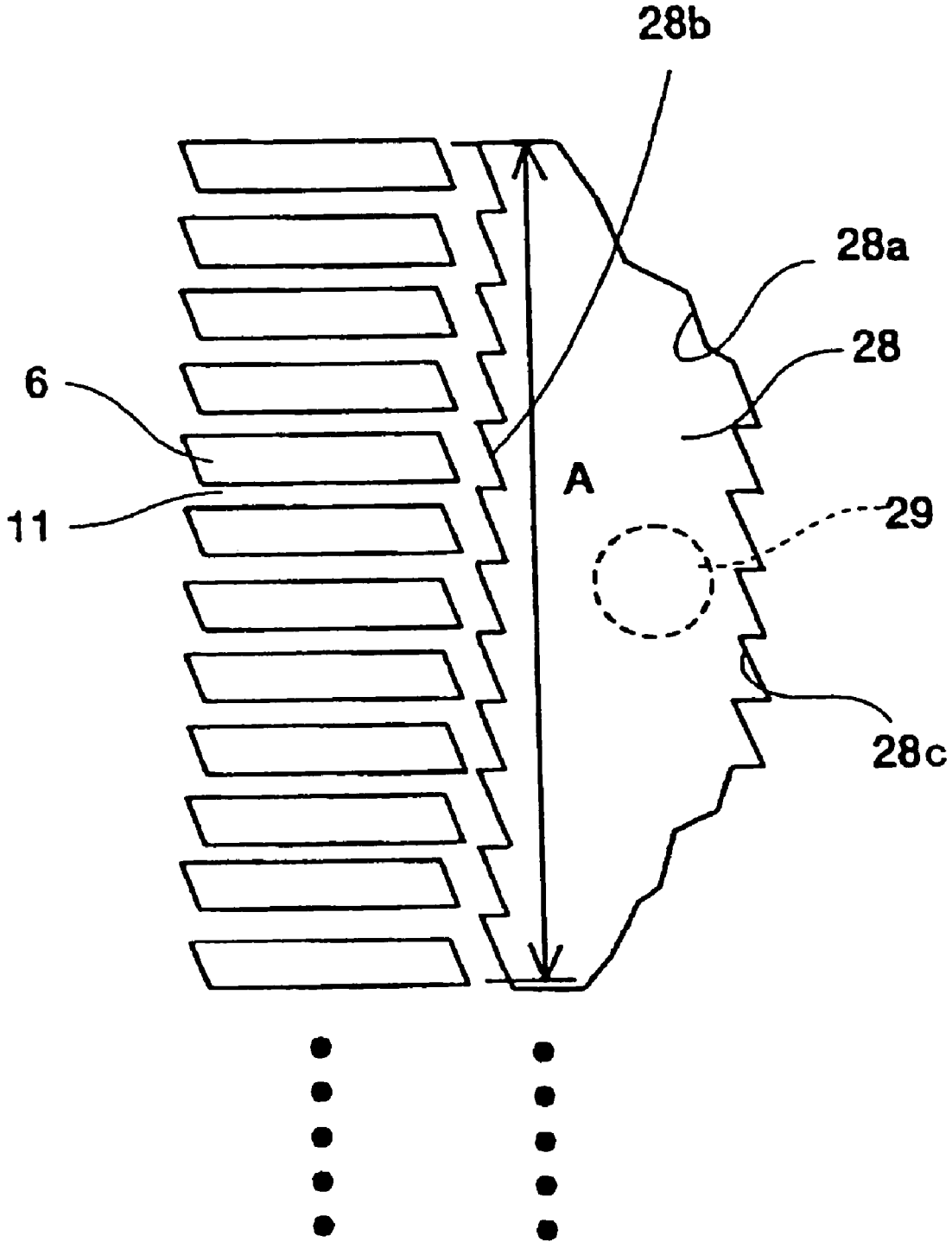
FIG. 14 is a plan view for explaining a configuration of a liquid room in an ink jet head of an eighth embodiment according to the present invention.

Next, an ink jet head of an eighth embodiment of the present invention will be described with reference to FIG. 14. FIG. 14 is a plan view for explaining a configuration of a liquid room in an ink jet head of an eighth embodiment according to the present invention.

In this embodiment, the wall surface 28*c*, which is parallel to the wall surface 28*b* situated at the side of liquid rooms 6 in the common liquid room 8, is provided at a vicinity of the ink supply opening part 29 in the wall surface 28*a* situated opposite to the side of liquid rooms 6 in the common liquid room 8.

Hence, the width of the common liquid room 28 at the wall surface 28*c* is wide, and it is possible to increase the capacity of the common liquid room 28. As a result, the ink supply is more secure.

Figure 15:
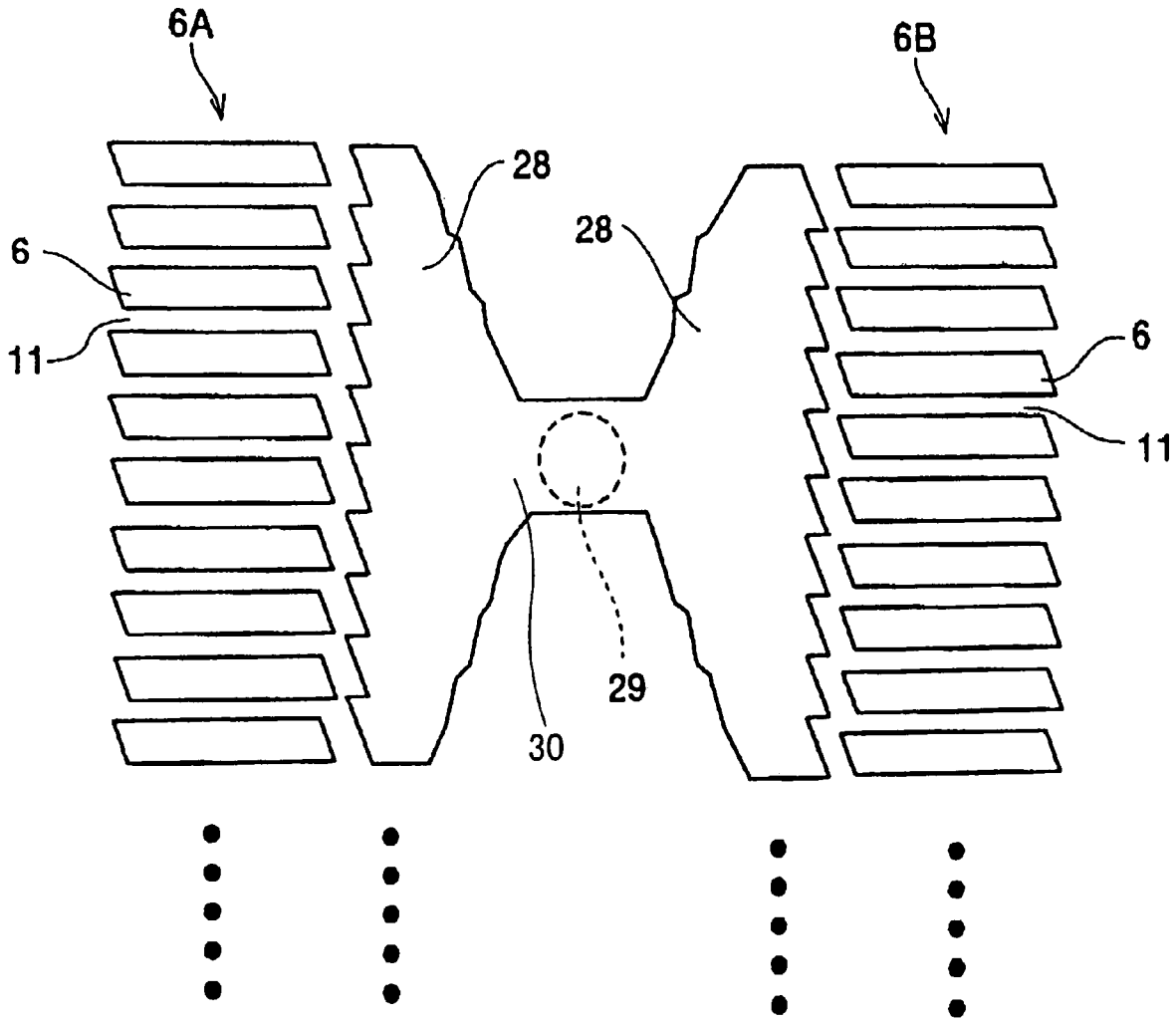
FIG. 15 is a plan view for explaining a configuration of a liquid room in an ink jet head of a ninth embodiment according to the present invention.

Next, an ink jet head of a ninth embodiment of the present invention will be described with reference to FIG. 15. FIG. 15 is a plan view for explaining a configuration of a liquid room in an ink jet head of a ninth embodiment according to the present invention.

In this embodiment, two lines of the liquid rooms 6 are arranged, namely two lines of the nozzles 5 are arranged, so that the lines of liquid rooms 6A and 6B are arranged zigzag. The respective common liquid rooms 28 in the seventh embodiment are provided in a direction of a line of the liquid rooms 6 between the lines of liquid rooms 6A and 6B. Furthermore, an ink channel 30 connected to the common liquid rooms 28 neighboring each other is arranged between the lines of liquid rooms 6A and 6B. The ink supply opening part 29 is arranged in the ink channel 30.

As a result of this, even if the number of the nozzles increases, it is possible to supply the ink from one ink supply opening part to the left and right common liquid rooms. The ink jet head in the ninth embodiment has a simple structure.

Figure 16:
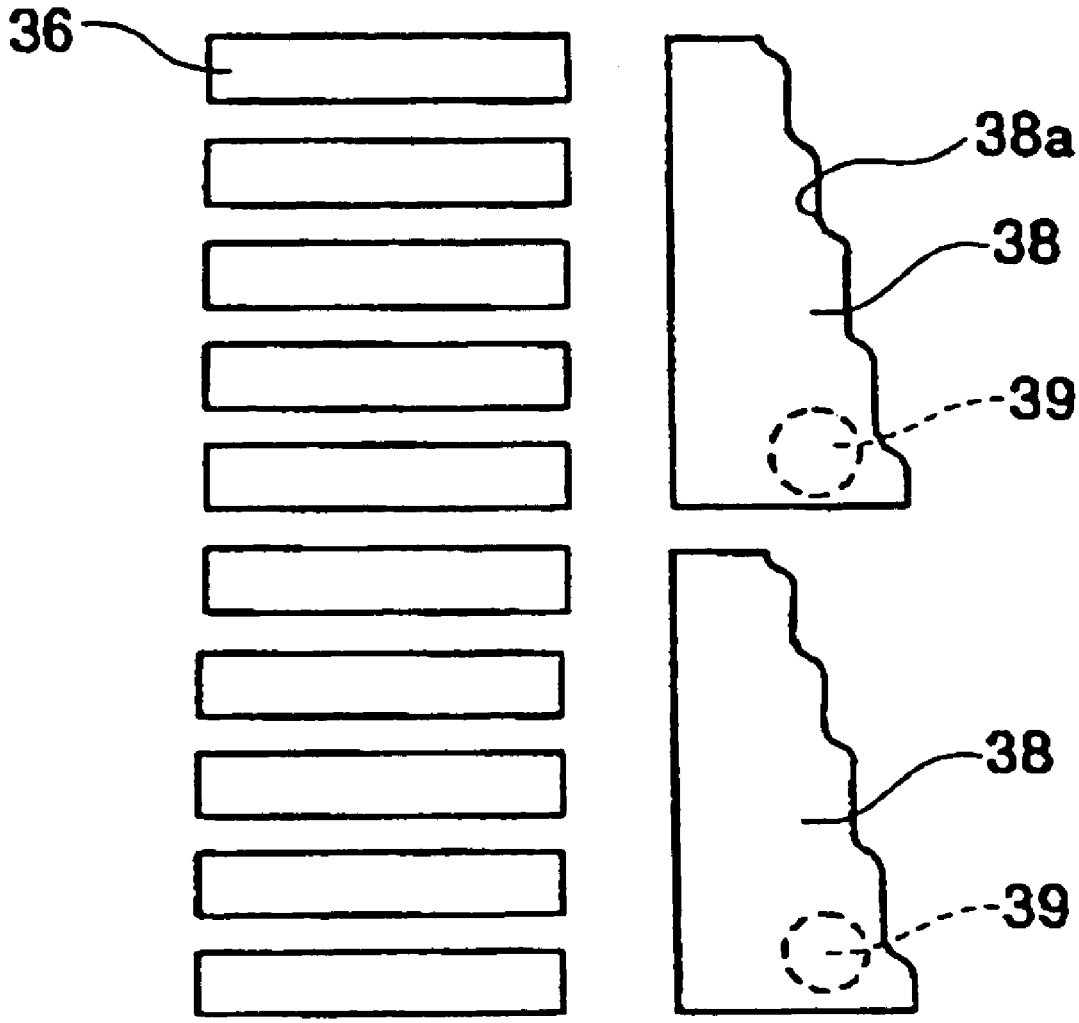
FIG. 16 is a plan view for explaining a configuration of a liquid room in an ink jet head of the tenth embodiment according to the present invention.

Next, an ink jet head of a tenth embodiment of the present invention will be described with reference to FIG. 16. FIG. 16 is a plan view for explaining a configuration of a liquid room in an ink jet head of the tenth embodiment according to the present invention.

In this embodiment, a liquid room 36 having a substantially rectangular configuration is formed by etching the channel substrate with Pyrex glass, ceramics, or others or formed by a sand blast method. The plural common liquid rooms 38 are divided in a direction of a line of the liquid rooms 36 as in the above mentioned embodiments. Furthermore, the wall surface 38*a* opposite to the side of the liquid rooms 36 in the common liquid room 38 is gradually narrower as a point of the width is more remote from the ink supply opening part 39.

Thus, in a case where an ink channel such as the liquid room or the common liquid room is formed by etching with the Pyrex glass, ceramics, or others or by the sand blast method, the wall surface does not have the same configuration as the configuration of the saw teeth formed by anisotropically etching of the silicon, for example. According to the present invention, it is possible to discharge the bubble accurately and prevent the speed of the ink at the end of the common liquid room from slowing. As a result, it is possible to supply the ink sufficiently. The wall surface 38*a* at the opposite side to the side of the liquid rooms 36 in the common liquid room 38 can be lineally narrower as the point of the width is more remote from the ink supply opening part 39 as also shown in FIG. 12.

The inventors of the present invention experimented with a number of the liquid rooms to which the common liquid room corresponds in a case where the common liquid room is divided in plural arranged in a direction of a line of the liquid rooms.

More particularly, the inventors experimented and compared the result of the discharge of the bubbles by changing the number of the common liquid rooms parted. In the experiment, the ink jet head included the liquid rooms 6 having a pitch of 150 dpi (169 μm pitch), as shown in FIG. 13 and the common liquid rooms 28 having a height of 100 μm. The experiment was implemented by changing the length of the common liquid room 28, namely the length in a direction of a line of the liquid rooms 6.

In this case, if the bubble was discharged from the nozzle by absorbing, whether or not the bubble remained in the common liquid room 28 was evaluated. A result of the evaluation is mentioned in the following chart. In the experiment, ten samples were implemented with respective conditions. In the chart, "common liquid room partition" indicates the number of channels, namely the number of liquid rooms connected to the common liquid room.

| Common Liquid Room Partition | Result of Bubble Discharge |
|---|---|
| 8 CH | ○ |
| 16 CH | ○ |
| 24 CH | ○ |
| 32 CH | Δ |
| 48 CH | X |
| 64 CH | X |
| 96 CH | X |

○: All samples having no bubble
Δ: Eight or more samples having no bubble
X: Less than eight samples having no bubble According to the result of the evaluation, it is preferable for the common liquid room to have 32 channels or less, more preferably 24 channels or less. That is, it is preferable that the number of liquid rooms 6 to which one common liquid room 28 corresponds be between two or more and thirty two.

Figure 17:
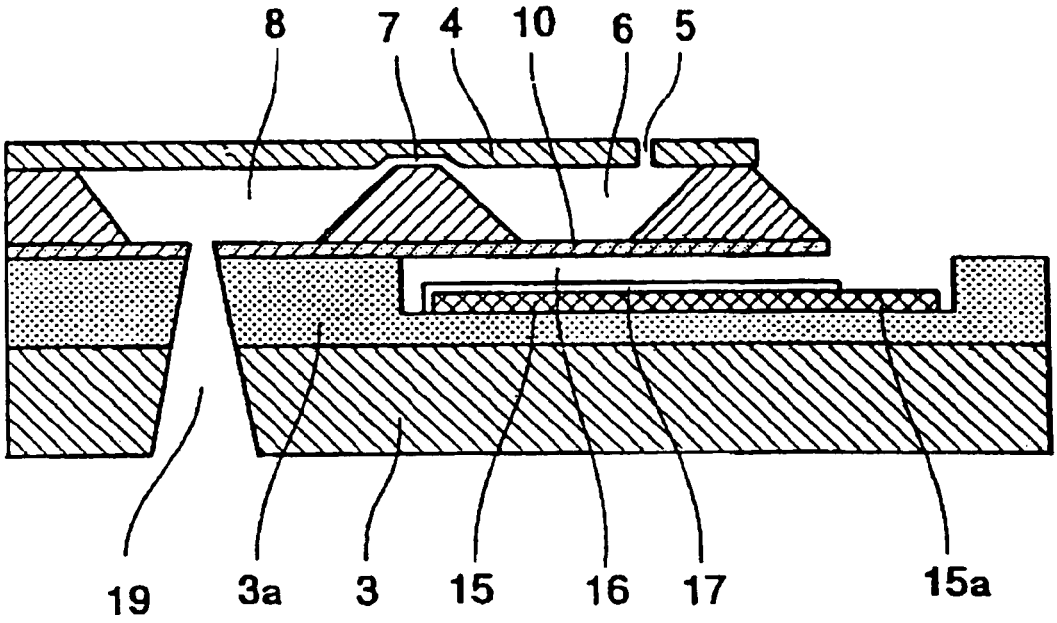
FIG. 17 is a roughly sectional view taken along a long axis of a liquid room in an ink jet head of the eleventh embodiment according to the present invention.

Next, an ink jet head of an eleventh embodiment of the present invention will be described with reference to FIG. 17. FIG. 17 is a roughly sectional view taken along a long axis of a liquid room in an ink jet head of the eleventh embodiment according to the present invention.

The ink jet head includes the ink supply opening part 19 formed in the electrode substrate 3. The ink is supplied from a surface at an opposite side to the nozzle board 4 to the common liquid room 8 or other common liquid room 28 or 38.

When a silicon substrate is used as the electrode substrate 3, the ink supply opening part 19 can be formed by anisotropically etching as well as can the liquid room 6 or the common liquid room 8 be formed. When a silicon substrate having a surface direction of (100) is used as the electrode substrate 3, an etching opening part having one of a rectangular and a square shape can be obtained. In the anisotropically etching, if the etching mask layer pattern is made by photolithography, a large number of the opening parts, namely the ink supply opening parts can be formed at the same time and thereby it is possible to reduce the cost.

When the Pyrex glass substrate is used as the electrode substrate 3 instead of a silicon substrate, the ink supply opening part 19 can be formed by etching or the sand blast method. Furthermore, as a method for forming a piercing hole into the substrate, there are not only the above described methods but also a process method, namely a mechanical process such as the sand blast method, a drill process, an ultrasonic process, or a laser process, or etching. The method for forming a piercing hole into the substrate can be selected appropriately based on the material of which the electrode substrate consists.

Thus, it is possible to supply the ink from a back surface of the ink jet head by providing the ink supply opening part at the electrode substrate side. As a result, it is not necessary to provide a pipe such as an ink supply pipe at the side of the nozzle board, so that the ink jet head can be miniaturized.

Figure 18:
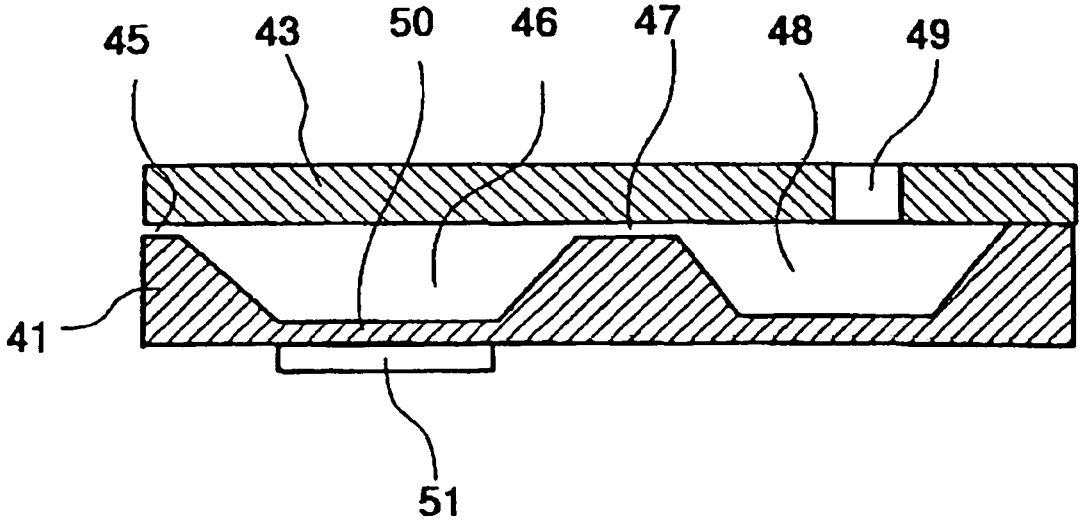
FIG. 18 is a roughly sectional view taken along a long axis of a liquid room in the ink jet head of a twelfth embodiment of the present invention.

Next, another example of an ink jet head to which the present invention is applied will be described with reference to FIG. 18. FIG. 18 is a roughly sectional view taken along a long axis of a liquid room in the ink jet head of a twelfth embodiment according to the present invention.

The ink jet head in this embodiment is a piezo type using a piezoelectric element as a pressure generating means. The direction of jetting the ink drop is along the long axis of the liquid room so that an edge shooter method head can be obtained as the ink jet head of this embodiment. That is, in the ink jet head in this embodiment, a channel substrate 41 is connected to a lid member 44 so that a nozzle 45, a vibration board 50 connected to the nozzle 45, a liquid room 46, and a common liquid room 48 connected by a liquid resister part 47 are provided. The ink is supplied from the ink supply opening part 49 formed in the lid member 44.

A silicon substrate can be used as the channel substrate 41. A groove forming the nozzle 45, a concave part forming the liquid room 46 and the vibration board 50, a groove forming the liquid resister part 47, and a concave part forming the common liquid room 48 are formed by anisotropically etching the silicon substrate. The piezoelectric element 51 deforming the vibration board 50 is provided at an external side of a surface of the vibration board 50 of the channel substrate 41. As a piezoelectric element 51, a single layer structure or multiple layer structure wherein a piezoelectric layer is put between the electrodes, or stacking type piezoelectric element in which an internal electrode and piezoelectric layer are stacked reciprocally is used. The piezoelectric element 51 may be provided at a side of the lid member 44.

In the piezo type ink jet head, the bubble discharge can be improved by making a configuration of the common liquid room 48 like the common liquid room 8, 28, or 38. As a result, ink supply can be implemented sufficiently. The side shooter method is used in the above mentioned and respective embodiments. The edge shooter method, wherein the direction of jetting of the ink drop is along a long axis of a liquid room, can be applied to the electrostatic type ink jet head described above.

Figure 19:
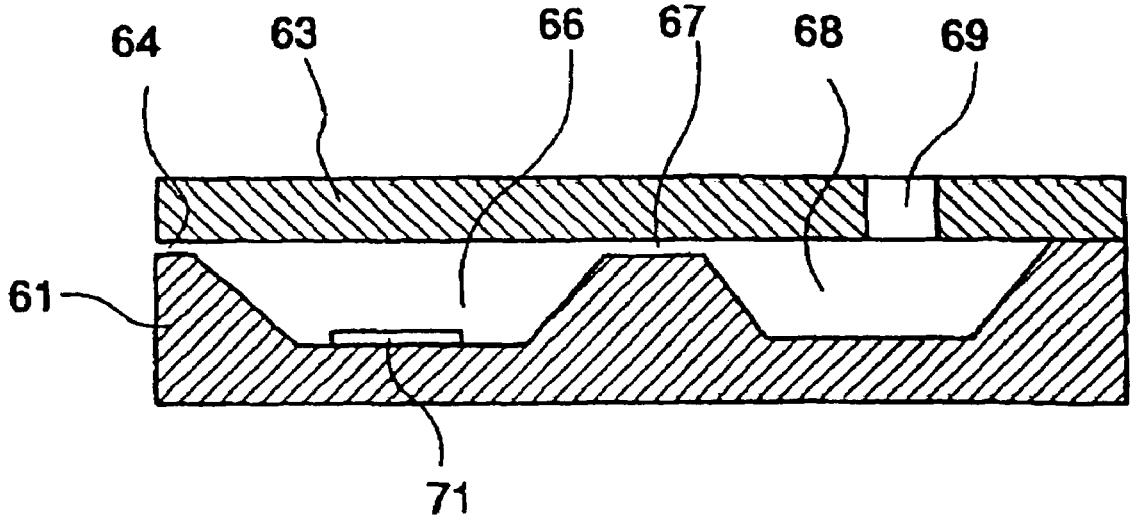
FIG. 19 is a roughly sectional view taken along a long axis of a liquid room in the ink jet head of a thirteenth embodiment according to the present invention.

FIG. 19 is a roughly sectional view taken along a long axis of a liquid room in the ink jet head of a thirteenth embodiment according to the present invention.

The ink jet head in this embodiment is a thermal type head using a heat resister body, namely an electric heat exchange element as a pressure generating means. In the ink jet head in this embodiment as well as the twelfth embodiment, a channel substrate 61 is connected to a lid member 63 so that a nozzle 64, a liquid room 66 connected to the nozzle 64, or a common liquid room 68 formed by a liquid resister part 67 are formed. The ink is supplied from the ink supply opening part 69 formed in the lid member 63 to the common liquid room 68.

A silicon substrate is used as the channel substrate 61. A groove forming the nozzle 64, a concave part forming the liquid room 66, a groove forming the liquid resister part 67, and a concave part forming the common liquid room 68 are formed by anisotropically etching the silicon substrate. The heat resister body 71 boiling an ink film is provided in the liquid room 66 of the channel substrate 61. The heat resister body 71 may be provided at a side of the lid member 64.

In the thermal type ink jet head, a configuration of the common liquid room 68 can be made as the above mentioned common liquid rooms 8, 28, or 38. As a result, the bubble discharge can be improved and it is possible to supply the ink.

It is also possible to provide the ink supply opening part for supplying the ink from a surface opposite to the side of the lid member to the common liquid room in the piezo type or the thermal type ink jet head as well as the eleventh embodiment.

In a case where the channel substrate is formed by a silicon substrate, silicon may be invaded by some kinds of the ink. In this case, a film having a register against the ink such as a silicon oxide film, a titanium nitride film, or a polyimide film can be formed on an internal wall surface to which the ink is connected such as the wall surface of the liquid room or the common liquid room.

Figure 20:
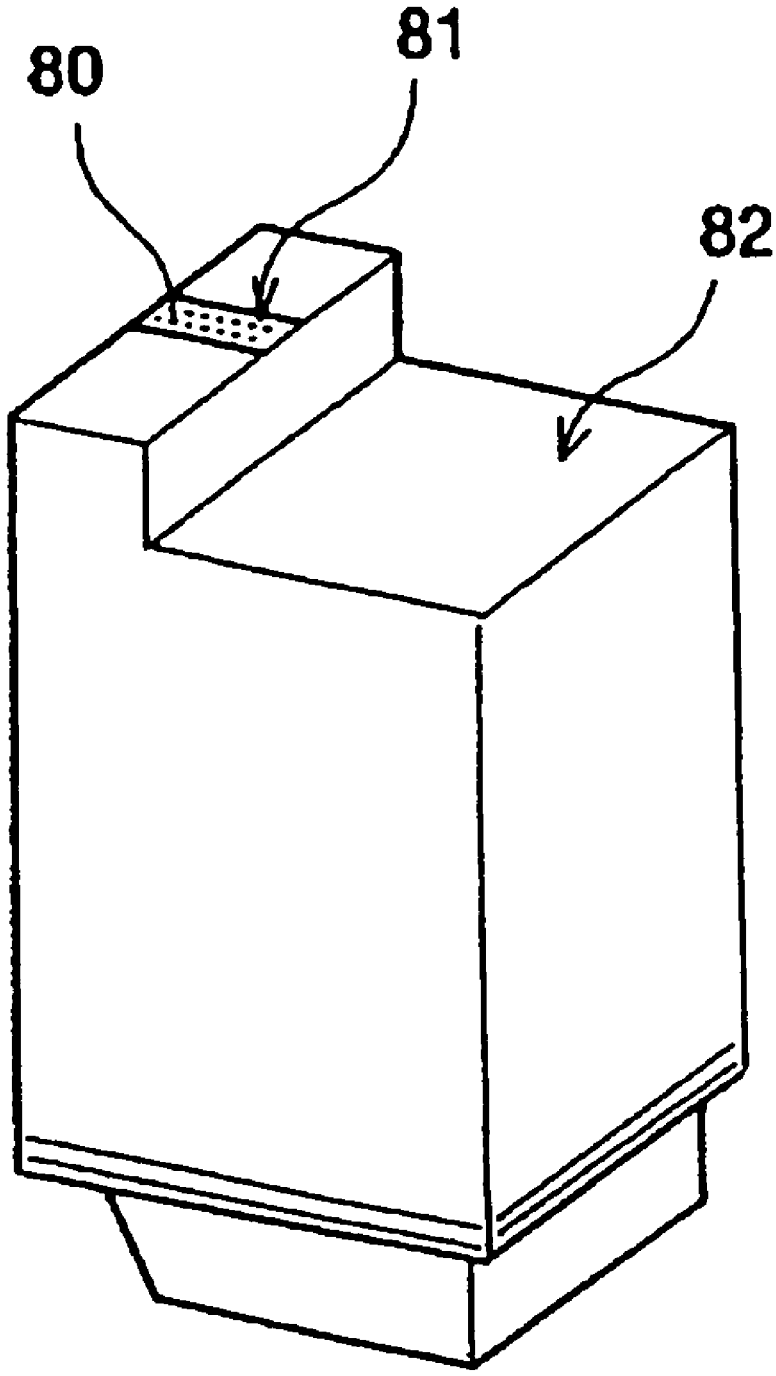
FIG. 20 is a perspective view of an ink cartridge of the present invention.

FIG. 20 is a perspective view of an ink cartridge of the present invention.

The ink cartridge is formed by unifying an ink jet head 81 having the nozzle 80 and others in the above mentioned respective embodiments and an ink tank 82 for supplying the ink to the ink jet head 81.

In this ink jet head within which the ink tank is unified, a bad condition of a yield of the head causes a bad condition of the whole ink cartridge. Therefore, it is possible to reduce a bad condition of the ink drop jet due to bubble stagnation. As a result, the yield of the ink cartridge improves so that a reduction of the cost of the head unification type ink cartridge can me realized.

Figure 21:
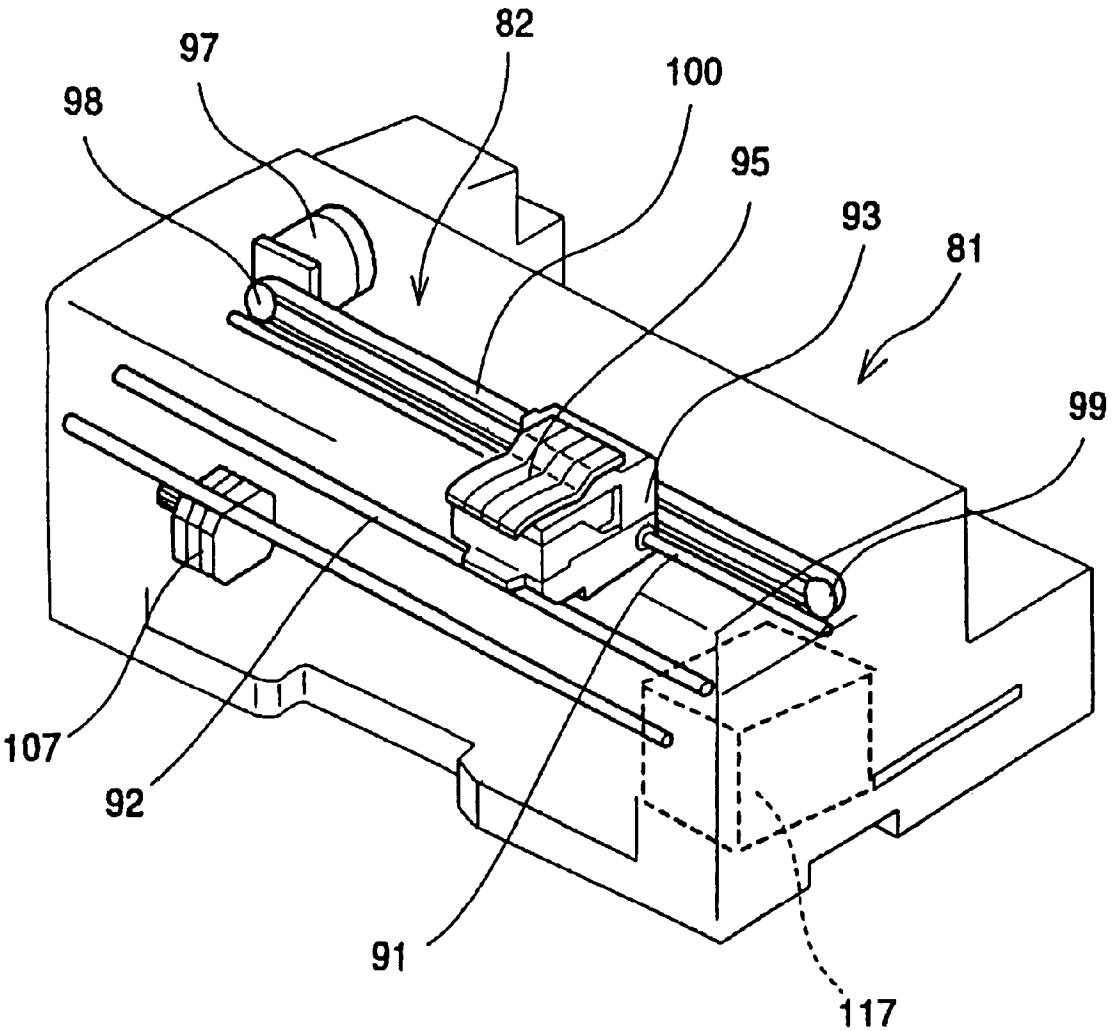
FIG. 21 is a perspective view of an ink jet recording apparatus in which the ink jet head of the present invention is mounted.
Figure 22:
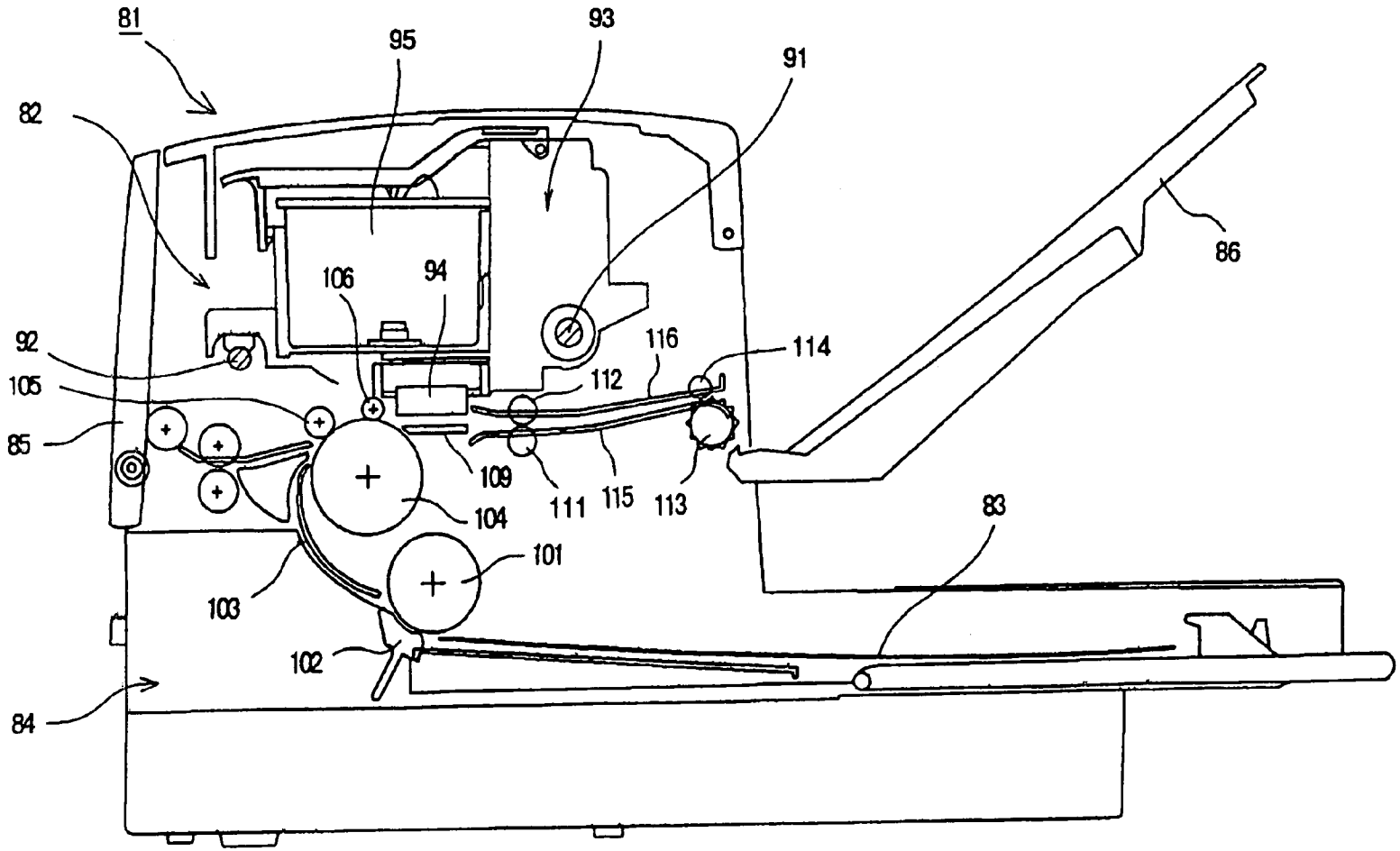
FIG. 22 is a sectional view of a mechanism part of the ink jet recording apparatus in which the ink jet head of the present invention is mounted.

Next, an ink jet recording apparatus in which the ink jet head of the present invention is used will be described with reference to FIGS. 21 and 22. FIG. 21 is a perspective view of an ink jet recording apparatus in which the ink jet head of the present invention is mounted. FIG. 22 is a sectional view of a mechanism part of the ink jet recording apparatus in which the ink jet head of the present invention is mounted.

The ink jet recording apparatus includes a recording apparatus body part 81 and a printing mechanism part 82. The printing mechanism part 82 is housed in the recording apparatus body part 81. A carriage movable in a main scanning direction, a recording head comprising the ink jet head of the present invention mounted on the carriage, the ink cartridge for supplying the ink to the recording head, and others are housed in the printing mechanism part 82. A paper supply cassette 84 (a paper supply tray) capable of loading a lot of paper 83 from a front side can be connected detachably at a lower part of the recording apparatus body part 81. In addition, a manual paper supply cassette 85 for supplying the paper 83 manually can be opened at the lower part of the recording apparatus body part 81. The paper 83 is taken from the paper supply cassette 84 and the manual paper supply cassette 85 in the printing mechanism part 82. A picture is recorded by the printing mechanism part 82 and then discharged to the paper discharge tray 86 connected to a back surface side of the recording apparatus body part 81.

In the printing mechanism part 82, a carriage 93 is held slidably in a main scanning direction namely a direction perpendicular to the paper of FIG. 22 by a guide member. A guide member is connected to left and right side boards not shown in FIG. 22. The guide member includes a main guide rod 91 and a sub guide rod 92. In the carriage 93, a recording head 94 is arranged in a direction where plural ink jet opening parts (nozzles) cross in the main scanning direction. Ink drops having colors of yellow, cyanogen, magenta, and black are jetted by the ink jet head. The recording head 94 is mounted in a state where a direction of the ink jet faces downward. In the carriage 93, respective ink cartridges 95 supplying ink having the respective colors to the recording head 94 are connected detachably.

An air opening connected to the air opening part is provided at an upper part of the ink cartridge 95. A supply opening part supplying the ink to the ink jet head is provided at a lower part of the ink cartridge 95. The ink is supplied to the ink jet head by a capillary of a porous body maintaining a slightly negative pressure. Although the head 94 for the respective colors is used as the recording head in this embodiment, one head having a nozzle jetting the respective colors may be used.

A back side, namely a lower side in a paper carriage direction, of the carriage 93 is clamped by the main guide rod 91 slideably. In addition, a front side, namely an upper side in a paper carriage direction, of the carriage 93 is connected by the sub guide rod 92 slideably. In order to make the carriage 93 move to scan in the main scaning direction, a timing belt 100 is stretch-connected between a driving pulley 98 rotationally driven by the main scan motor 97 and a driven pulley 99. The timing belt 100 is fixed at the carriage 93 and the carriage moves and returns by forward and backward rotations of the main scan motor 67.

On the other hand, in, order to carry the paper 83 set at the paper supply cassette 84 to a lower side of the recording head 94, a supply paper roller 101, a friction pad 102, a guide member 103, a carry roller 104, a small roller 105, and a head end roller 106 are provided in the ink jet recording apparatus separately. Each of the sheets of paper 83 is carried from the supply paper cassette 84. The paper 83 is guided by the guide member 103. The paper 83 is carried by turning over with the carry roller 104. The small roller 105 is pushed on a circumference surface of the carry roller 104. A pushing angle on the paper 83 by the carry roller 104 is determined by the head end roller 106. The carry roller 104 is rotate driven by a sub scan motor 107 with a gear line.

The paper 83 pushed by the carry roller 104 corresponding to a moving area in the main scan direction of the carriage 93 is received by a print receiving member 109 as a paper guide member guiding in a lower direction of the recording head 94. A carry roller 111 rotationally driven to carry the paper 83 in a discharge paper direction and a spur 112, a discharge paper roller 113 for carrying the paper 83 to the paper discharge tray 86, a spur 114, and guide members 115 and 116 forming a paper discharge route are provided at the lower side of the paper carry direction of the print receiving member 109.

At the time of recording, the recording head 94 is driven based on a picture signal and the carriage 93 is moved. The ink is jetted to the paper 83 which does not move so that one line is recorded on the paper 83. After that, the paper 83 is moved a designated distance and the next line is recorded. The recording operation is finished by receiving a record finishing signal or a signal indicating that a rear end part of the paper 83 arrives at a recording area, so that the paper 83 is discharged.

A recovery apparatus 117 for recovering from a bad jetting of the recording head 94 is arranged at an outside position of the recording area, namely a right end side of the moving direction of the carriage 93. The recovery apparatus 117 includes a cap means, an absorption means, and a cleaning means. During waiting for ready for printing, the carriage 93 is moved to a side of the recovery apparatus 117. The recording head 94 is capped by the cap means. The bad jetting based on an ink dry condition can be prevented by maintaining the jet opening part in a wet state. In addition, the ink not used for recording is jetted during recording so that coefficients of viscosity of all of the jet opening parts are kept constant, and thereby a stable jetting ability can be maintained.

In a case where the bad jetting occurs, the jet opening part such as the nozzle of the head 94 is sealed by a cap means. The bubble with the ink is absorbed from the jet opening part through a tube by the absorption means. The ink, the dust or the like which adheres to the jet opening surface is removed by the cleaning means so that the bad jetting is recovered. In addition, the ink which is absorbed is discharged to a waste ink saver arranged at a lower part of the body but not shown in FIG. 21 so that the ink is absorbed and maintained by an ink absorption body inside of the waste ink saver.

Thus, the ink jet head of the present invention is mounted in the ink jet recording apparatus. Accordingly, the bad jetting of the ink liquid due to bubble stagnation can be avoided so that it is possible to obtain a stable condition of the jetting of the ink liquid. Hence, quality of the picture can be improved.

The present invention is not limited to these embodiments, but variations and modifications may be made without departing from the scope of the present invention. For instance, although the present invention is applied to the ink jet head in the respective embodiments, the present invention can be applied to a liquid drop jet head for jetting a liquid resist for pattering, too.

This patent application is based on Japanese priority patent application No. 2001-093574 filed on Mar. 28, 2001, the entire contents of which are hereby incorporated by reference.

What is claimed is:

1. An ink cartridge comprising:

an ink jet head; and an ink rank configured to supply ink to the ink jet head, the ink jet head comprising:

a nozzle jetting a liquid drop;

liquid rooms connected to the nozzle;

a common liquid room connected to the liquid rooms, to which the liquid is supplied from a supply opening part; wherein a width of the common liquid room decreases with an increase of a distance from the supply opening part, and the supply opening part is placed at an end part of the common liquid room in a direction of a line of the liquid rooms.

2. The ink cartridge as claimed in claim 1, wherein the width of the common liquid room on a plane level is narrower substantially consecutively as a point of the width is more remote from the supply opening part.

3. The ink cartridge as claimed in claim 1, wherein the width of the common liquid room on a plane level is narrower substantially gradually as a point of the width is more remote from the supply opening part.

4. The ink cartridge as claimed in claim 1, wherein the common liquid room has a configuration of a single wing on a plane level.

5. The ink cartridge as claimed in claim 1, wherein the common liquid room has a configuration of dual wings on a plane level.

6. The ink cartridge as claimed in claim 5, wherein a wall surface opposite to a liquid room side in the common liquid roam has a substantially arc configuration or a semicircle configuration in a direction of a line.

7. The ink cartridge as claimed in claim 1, wherein the common liquid room is formed by anisotropically etching of a silicon substrate.

8. The ink cartridge as claimed in claim 7, wherein the common liquid room has a wall surface at a liquid room side of the common liquid room, and the wall surface has a plane configuration having an obtuse angle.

9. The ink cartridge as claimed in claim 1, wherein the supply opening part is provided at a surface opposite side to a lid member or a nozzle board forming a wall surface of the liquid room.

10. A picture recording apparatus comprising an ink jet head, the ink jet head comprising:

a nozzle jetting a liquid drop;

liquid rooms connected to the nozzle;

a common liquid room connected to the liquid rooms, to which the liquid is supplied from a supply opening part; wherein a width of the common liquid room decreases with an increase of a distance from the supply opening part, and the supply opening part is placed at an end part of the common liquid room in a direction of a line of the liquid rooms.

11. The picture recording apparatus as claimed in claim 10, wherein the width of the common liquid room on a plane level is narrower substantially consecutively as a point of the width is more remote front the supply opening part.

12. The picture recording apparatus as claimed in claim 10, wherein the width of the common liquid room on a plane level is narrower substantially gradually as a point of the width is more remote from the supply opening part.

13. The picture recording apparatus as claimed in claim 10, wherein the common liquid room has a configuration of a single wing on a plane level.

14. The picture recording apparatus as claimed in claim 10, wherein the common liquid room has a configuration of dual wings on a plane level.

15. The picture recording apparatus as claimed in claim 14, wherein a wall surface opposite to a liquid room side in the common liquid room has a substantially arc configuration or a semicircle configuration in a direction of a line.

16. The picture recording apparatus as claimed in claim 10, wherein the common liquid room is formed by anisotropically etching of a silicon substrate.

17. The picture recording apparatus as claimed in claim 16, wherein the common liquid room has a wall surface at a liquid room side of the common liquid room, and the wall surface has a plane configuration having an obtuse angle.

18. The picture recording apparatus as claimed in claim 10, wherein the supply opening part is provided at a surface opposite side to a lid member or a nozzle board forming a wall surface of the liquid room.

* * * * *